US009820564B2

(12) United States Patent
Mullins

(10) Patent No.: US 9,820,564 B2
(45) Date of Patent: Nov. 21, 2017

(54) WORKTOP AND A METHOD AND A SUPPORT MECHANISM FOR SUPPORTING A WORKTOP

(71) Applicant: John Mullins, Ardagh (IE)

(72) Inventor: John Mullins, Ardagh (IE)

( * ) Notice: Subject to any disclaimer, the term of this patent is extended or adjusted under 35 U.S.C. 154(b) by 0 days.

(21) Appl. No.: 14/386,505

(22) PCT Filed: Mar. 22, 2013

(86) PCT No.: PCT/IE2013/000009
§ 371 (c)(1),
(2) Date: Sep. 19, 2014

(87) PCT Pub. No.: WO2013/140385
PCT Pub. Date: Sep. 26, 2013

(65) Prior Publication Data

US 2015/0048228 A1 Feb. 19, 2015

(30) Foreign Application Priority Data

Mar. 22, 2012 (IE) ..... S2012/0147
Apr. 27, 2012 (IE) ..... S2012/0208

(51) Int. Cl.
*A47B 3/00* (2006.01)
*A47B 5/04* (2006.01)
*A47B 3/091* (2006.01)

(52) U.S. Cl.
CPC ..... *A47B 5/04* (2013.01); *A47B 3/0916* (2013.01); *Y10T 29/4984* (2015.01)

(58) Field of Classification Search
CPC ..... A47B 5/04
(Continued)

(56) References Cited

U.S. PATENT DOCUMENTS 188,414 A * 3/1877 Rohde ..... A47B 1/04 108/80
701,666 A * 6/1902 Ank ..... F25D 3/08 108/134

(Continued)

OTHER PUBLICATIONS

International Search Report for PCT/IE2013/000009 dated Jun. 19, 2013.
Written Opinion for PCT/IE2013/000009 dated Jun. 19, 2013.

*Primary Examiner* — Matthew Ing
(74) *Attorney, Agent, or Firm* — Sughrue Mion, PLLC

(57) ABSTRACT

A worktop (1) comprising a leaf (3) hingedly coupled to a wall (6) about a hinge axis (7) by a pair of support mechanisms (91) between a usable state and a folded state. Each support mechanism (91) comprises a first mounting member (93) and a second mounting member (92) which are pivotally connected by a main pivot pin (94) which defines the hinge axis (7). A strut (15) extends between the first and second mounting members (93,92). A first pivot pin (19) at a first end (17) of the strut (15) is slideable and pivotal in an elongated first guide track (96) in the first mounting member (93) between first and second positions (73,74). A second pivot pin (20) at a second end (18) of the strut (15) is pivotal in a slideable element (25), which in turn is slideable in a second guide track (14) of the second mounting member (92) between first and second positions (26,27). A plunger (40) in the slideable element (25) engages a receiving opening (43) in the second guide track (14) for retaining the slideable element (25) in the first position (23) for retaining the leaf (3) in the usable state. On disengagement of the plunger (40) from the recess opening (43), the leaf (3) is pivoted downwardly in the direction of the arrow (A) from the usable state to the folded state, and the slideable element (25) slides to a second position (24) in the second guide track (14) while the first pivot pin (19) slides from the first (Continued)

Figure 1:
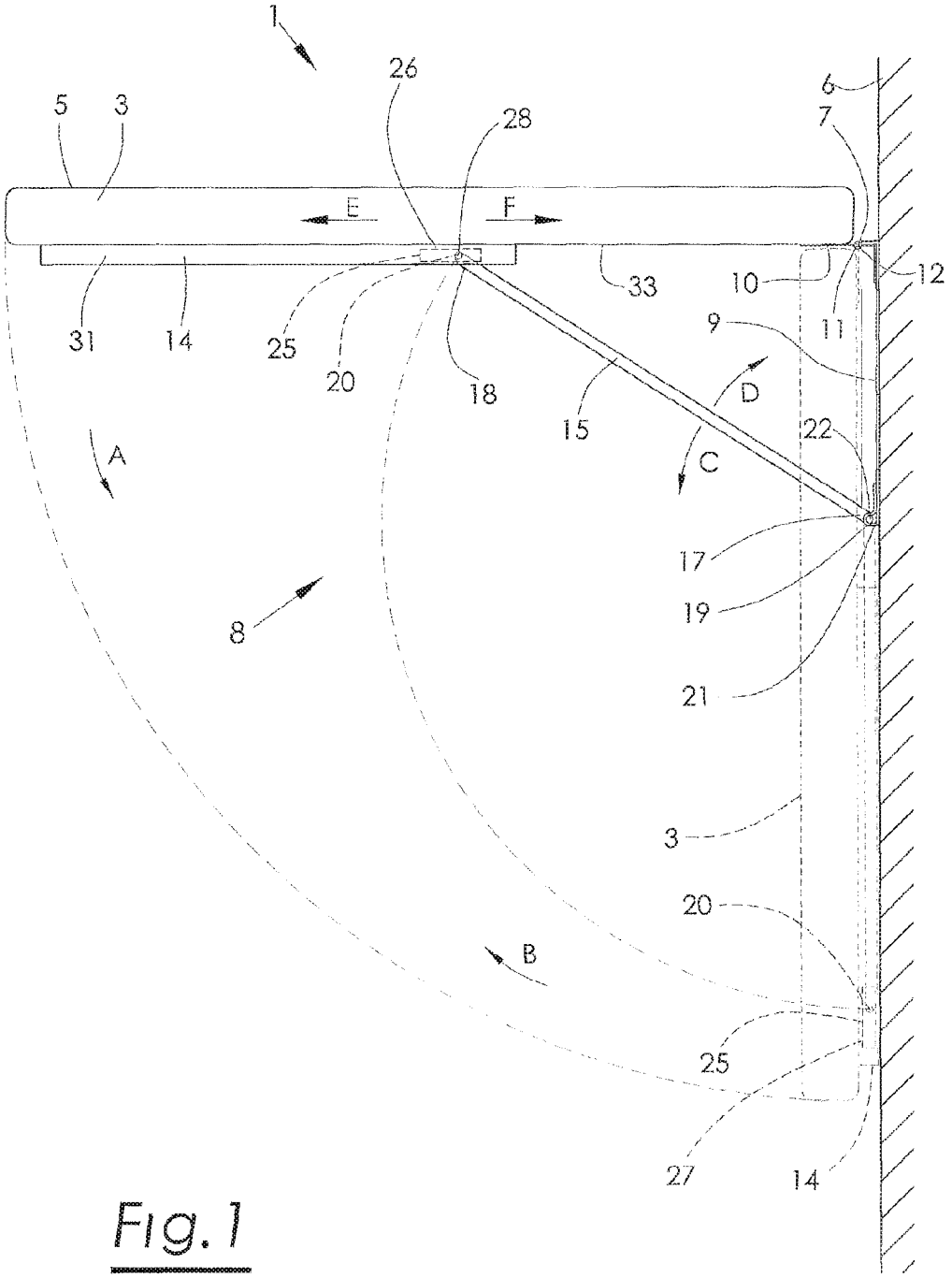

position (73) to the second position (74) in the first guide track (96).

20 Claims, 20 Drawing Sheets

(58) Field of Classification Search
USPC ..... 108/80–82, 108, 134, 135, 145
See application file for complete search history.

(56) References Cited

U.S. PATENT DOCUMENTS 2,031,287 A * 2/1936 Swanson ..... A47B 5/04
108/134
2,239,225 A * 4/1941 Gordon ..... A47B 5/04
108/134
3,661,431 A * 5/1972 Wisecarver ..... F16C 13/006
16/105
4,756,500 A * 7/1988 Baker ..... B25H 5/00
108/134
5,733,026 A * 3/1998 Munachen ..... A47B 88/0466
312/330.1

* cited by examiner

WORKTOP AND A METHOD AND A SUPPORT MECHANISM FOR SUPPORTING A WORKTOP

CROSS REFERENCE TO RELATED APPLICATIONS

This application is a National Stage of International Application No. PCT/IE2013/000009 filed Mar. 22, 2013, claiming priority based on Irish Patent Application Nos. S2012/0147 filed Mar. 22, 2012 and S2012/0208 filed Apr. 27, 2012, the contents of all of which are incorporated herein by reference in their entirety.

The present invention relates to a worktop, and in particular, to a worktop which is coupleable to a structure, for example, a wall, a kitchen unit, a table or the like and is foldable away from a usable state to a folded state. The invention also relates to a support mechanism for supporting a worktop in a usable state and permitting folding of the worktop between the usable state and a folded state. The invention also provides a method for supporting a worktop.

Foldable worktops are known, for example, end leaves of a table may be hingedly coupled to respective opposite ends of the table to fold downwardly when not in use. Additionally, worktops which form an extension to an existing worktop are also provided when not in use to be foldable downwardly. Such worktops, in general, are hingedly coupled to a structure, which supports the existing worktop, and are hingeable between a usable state extending substantially horizontally from and in line with the worktop to which they are hingedly coupled, and a folded state whereby the worktop depends downwardly from a hinge axis about which it is hingedly coupled to the existing worktop or structure thereof. Various support mechanisms are provided for supporting such worktops in the usable state and for facilitating hinging of the worktops from the usable state to the folded state. However, in general, such support mechanisms tend to be relatively flimsy, and in general, while they are adequate for supporting the worktop in the usable state they are unsuitable for supporting the worktop in the usable state when a relatively large load is to be supported on the worktop.

There is therefore a need for a worktop and for a support mechanism which addresses this problem. There is also a need for a method for supporting a worktop which also addresses the problem of known worktops.

The present invention is directed towards providing such a worktop and such a support mechanism, as well as a method for supporting a worktop.

According to the invention there is provided a support mechanism for supporting a worktop leaf hingedly coupled to a structure about a hinge axis, the support mechanism comprising a first mounting means adapted for coupling to the structure, a second mounting means adapted for coupling to the leaf and being adapted to be pivotal relative to the first mounting means about the hinge axis between a support state with the leaf in a usable state and a rest state with the leaf in a folded state, and an elongated strut extending between a first end engageable with the first mounting means, and a second end engageable with the second mounting means, at least one of the first and second ends of the strut being slideable relative to the corresponding one of the first and second mounting means from a first position with the strut in a first state supporting the second mounting means in the support state to a second position with the strut in a second state and the second mounting means in the rest state as the second mounting means is pivoted from the support state to the rest state.

Preferably, the other one of the first and second ends of the strut is pivotal in the corresponding one of the first and second mounting means. Advantageously, the strut is pivotal between the first state and the second state about the one of the first and second ends of the strut which is pivotal in the corresponding one of the first and second mounting means.

Advantageously, both the first and second ends of the strut are slideable relative to the corresponding one of the first and second mounting means between respective first and second positions corresponding to the first and second states of the strut.

Ideally, both the first and second ends of the struts are pivotal in the corresponding ones of the first and second mounting means.

In one aspect of the invention each of the first and second ends of the strut which are slideable in the corresponding one of the first and second mounting means is slideable in a direction perpendicular to the hinge axis.

Preferably, one of the first and second ends of the strut is slideable in the corresponding one of the first and second mounting means in a direction towards the hinge axis when the second mounting means is being hinged from the rest state to the support state, and the other one of the first and second ends of the strut is slideable in the corresponding one of the first and second mounting means in a direction away from the hinge axis when the second mounting means is being hinged from the rest state to the support state. Advantageously, the second end of the strut is slideable in the second mounting means in a direction towards the hinge axis when the second mounting means is being hinged from the rest state to the support state.

Preferably, the first position of the second end of the strut is closer to the hinge axis than the second position of the second end of the strut. Advantageously, the first position of the first end of the strut is more remote from the hinge axis than the second position of the first end of the strut.

Preferably, the first mounting means comprises an abutment means for locating the first end of the strut in the first position. Advantageously, the second mounting means comprises a retaining means for releasably retaining the second end of the strut in the first position.

In one aspect of the invention one of the first and second mounting means comprises an elongated guide track for guiding the corresponding one of the first and second ends of the strut between the first and second positions thereof.

In another aspect of the invention the first mounting means comprises a first guide means. Preferably, the first guide means comprises an elongated first guide track.

In a further aspect of the invention the second mounting means comprises a second guide means. Preferably, the second guide means comprises an elongated second guide track.

In one aspect of the invention the second end of the strut is slideable longitudinally in the second guide means between the first and second positions thereof.

In another embodiment of the invention the first end of the strut is slideable longitudinally in the first guide means between the first and second positions thereof.

Advantageously, the first end of the strut is pivotal in the first guide means about a first pivot axis for accommodating pivoting of the strut relative to the first guide means. Preferably, the first pivot axis extends substantially parallel to the hinge axis.

In another aspect of the invention the second end of the strut is coupled to a slideable element, the slideable element being slideably mounted in the second guide means and being slideable along the second guide means between the first and second positions of the second end of the strut. Preferably, the second end of the strut is pivotally coupled to the slideable element about a second pivot axis. Advantageously, the second pivot axis extends substantially parallel to the hinge axis.

In another aspect of the invention the retaining means comprises a detent located in one of the slideable element and the second mounting means, the detent being releasably engageable with a receiving means located in the other one of the slideable element and the second mounting means for releasably retaining the second end of the strut in the first position thereof. Preferably, the detent is located in the slideable element. Advantageously, the detent comprises a spring loaded plunger. Ideally, the spring loaded plunger is spring biased by a compression spring. Preferably, the compression spring acts between the slideable element and the plunger.

In another aspect of the invention the receiving means comprises a receiving opening formed in the second mounting means for receiving the detent.

In a further aspect of the invention a release means is provided for disengaging the detent from the receiving means. Preferably, the release means is manually operable for releasing the detent from the receiving means. Advantageously, the release means comprises an engagement member for engaging the detent to urge the detent out of engagement with the receiving means.

In one aspect of the invention the engagement member is spring biased out of engagement with the detent.

In another aspect of the invention the engagement member is slideably coupled to the second mounting means.

In a further aspect of the invention a connecting means is provided for connecting respective release means of a pair of support mechanisms.

Preferably, the strut is a rigid strut.

In one embodiment of the invention the first and second mounting means are pivotally coupled about a main pivot axis, the main pivot axis defining the hinge axis about which the leaf is hingeable between the usable and folded states.

Alternatively, a secondary mounting means is pivotally coupled to the first mounting means about a main pivot axis, the secondary mounting means being adapted for coupling to the leaf with the main pivot axis defined between the secondary mounting means and the first mounting means defining the hinge axis of the leaf.

Preferably, the support mechanism is adapted for hingedly coupling the leaf to the structure.

Advantageously, the support mechanism is configured so that when the second mounting means is in the support state with the leaf in the usable state, the leaf extends outwardly from the structure, and when the second mounting means is in the rest state with the leaf in the folded state, the leaf depends downwardly from the hinge axis.

Preferably, the support mechanism is adapted for supporting the leaf in the usable state with an upwardly facing worktop surface extending substantially horizontally from the structure.

Advantageously, the support mechanism is configured to lie between the leaf and the structure in the rest state of the second mounting means.

Advantageously, the support mechanism is configured so that the leaf is hingeable downwardly from the usable state to the folded state.

In one aspect of the invention the second mounting means is adapted for mounting on an underside of the leaf.

The invention also provides a worktop hingedly coupled to a structure by a support mechanism according to the invention, the first mounting means being coupled to the structure, and the second mounting means being coupled to the leaf, the second mounting means being pivotal from the support state supporting the leaf in the usable state to the rest state with the leaf in an unusable state as the leaf is pivoted about the hinge axis from the usable state to the folded state.

In one embodiment of the invention a pair of the support mechanisms are provided, the support mechanisms being axially spaced apart along the hinge axis, with the first mounting means of the respective support mechanisms being secured to the structure, and the second mounting means being secured to the leaf.

In another embodiment of the invention at least three support mechanisms are provided, the respective support mechanisms being axially spaced apart from each other along the hinge axis.

Preferably, the structures define a common main pivot axis.

Advantageously, the release means of the respective support mechanisms are connected by the connecting means for facilitating substantially simultaneous release of the detent of the retaining means of the respective support mechanisms from the respective receiving means.

Preferably, the common main pivot axis defined by the support mechanisms defines the hinge axis about which the leaf is hingedly coupled to the structure.

Further the invention provides a method for supporting a worktop leaf hingedly coupled to a structure about a hinge axis, the method comprising providing a support mechanism for supporting the leaf hingedly coupled to the structure, securing a first mounting means of the support mechanism to the structure, securing a second mounting means of the support mechanism to the leaf, the second mounting means being pivotal relative to the first mounting means about the hinge axis between a support state with the leaf in a usable state and a rest state with the leaf in a folded state, providing an elongated strut extending between a first end engageable with the first mounting means, and a second end engageable with the second mounting means, configuring at least one of the first and second ends of the strut to be slideable relative to the corresponding one of the first and second mounting means from a first position with the strut in a first state supporting the second mounting means in the support state to a second position with the strut in a second state and the second mounting means in the rest state as the second mounting means is pivoted from the support state to the rest state.

Preferably, the other one of the first and second ends of the strut is configured to be pivotal relative to the corresponding one of the first and second mounting means. Advantageously, the strut is pivotal between the first state and the second state about the one of the first and second ends of the strut which is pivotal in the corresponding one of the first and second mounting means.

Preferably, both the first and second ends of the strut are configured to be slideable relative to the corresponding one of the first and second mounting means between respective first and second positions corresponding to the first and second states of the strut.

Ideally, both the first and second ends of the struts are configured to be pivotal relative to the corresponding ones of the first and second mounting means.

Preferably, each of the first and second ends of the strut which are slideable in the corresponding one of the first and second mounting means is slideable in a direction perpendicular to the hinge axis.

The advantages of the invention are many. The support mechanism is particularly suitable for supporting relatively heavy worktops, and furthermore, is suitable for supporting relatively large loads which in turn are supported on the worktop. This advantage is largely achieved by virtue of the fact that an elongated strut is provided between the first and second mounting means, and the strut takes substantially the entire load of the worktop and any load supported by the worktop.

By providing both first and second mounting means as first and second guide means, and by permitting relative sliding and pivoting movement of the first and second ends of the strut relative to the corresponding ones of the first and second guide means during hinging of the leaf of the worktop between the usable and folded states of the leaf permits the use of a longer strut. The use of a longer strut allows the first end of the strut to be supported in the first mounting means when the second support means is in the support state at a greater distance from the hinge axis than when the first end of the strut is not slideable in the first mounting means. Additionally, by permitting sliding movement of the first end of the strut in the corresponding first mounting means, the angle to the vertical at which the strut extends when in the second state is less than when the second end of the strut is not slideable in the first mounting means, and with the strut extending at a more acute angle to the vertical, a greater load can be supported by the strut, and in turn, by each support mechanism.

A further advantage of the support mechanisms is achieved when two or more of the support mechanisms are provided to support a worktop leaf, and the respective release means are connected by a connecting means, such as a link member. By connecting the respective release means, the retaining means of the respective support mechanisms can be simultaneously released from the corresponding receiving means by one single manual operation.

Figure 2:
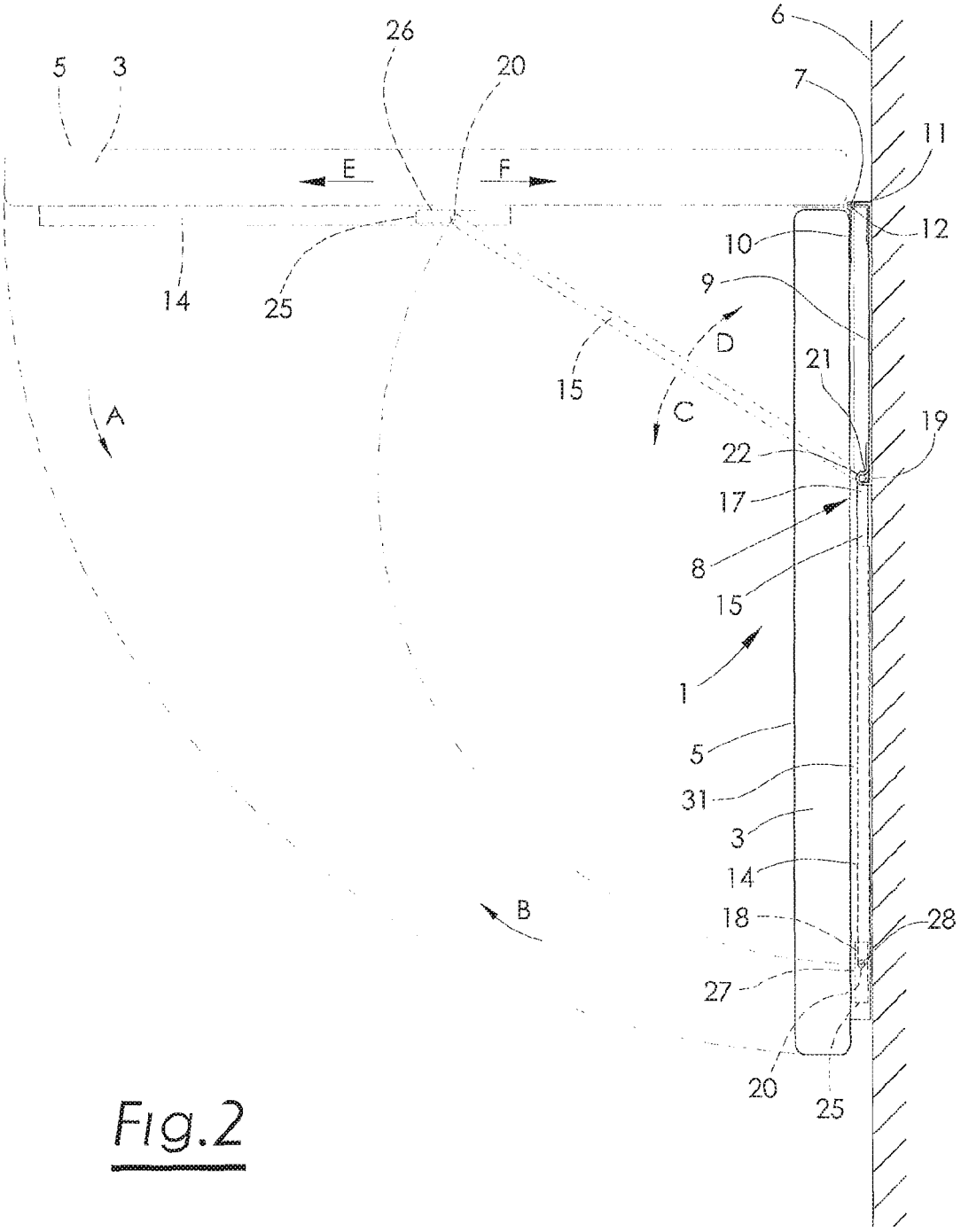
Figure 3:
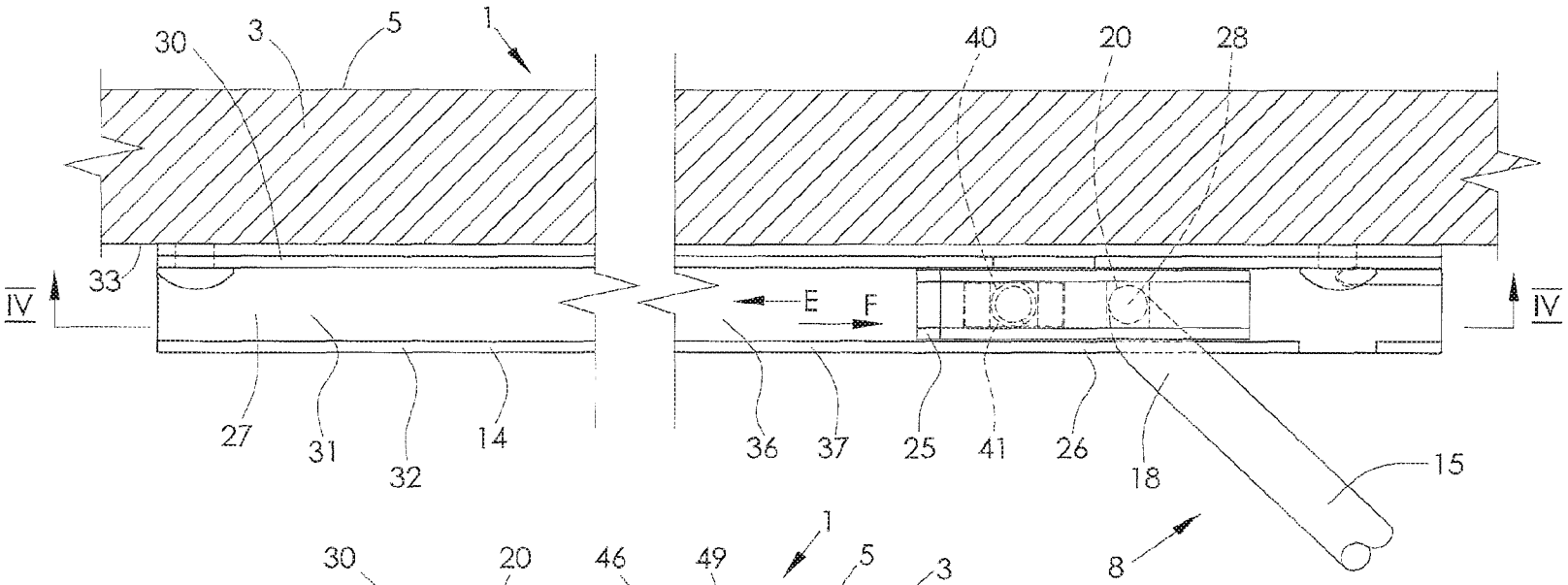
Figure 8:
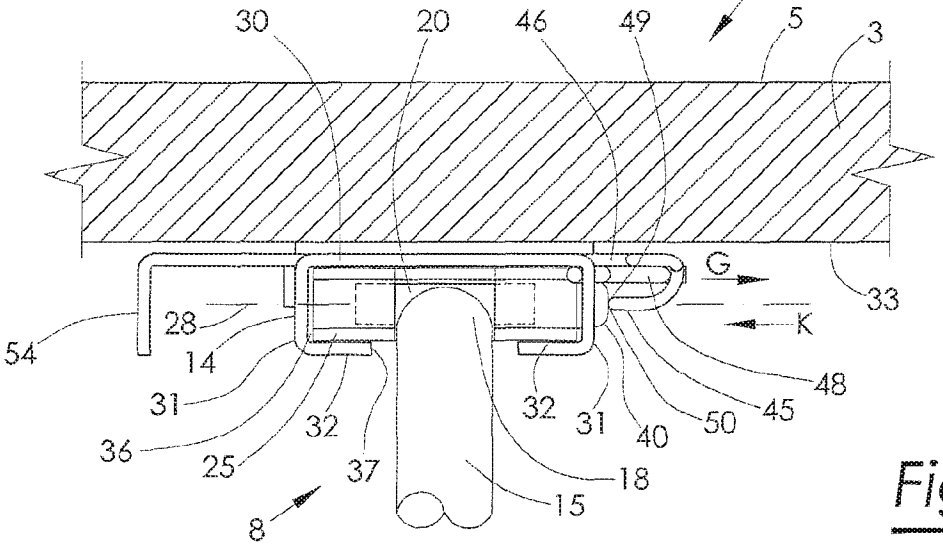
Figure 4:
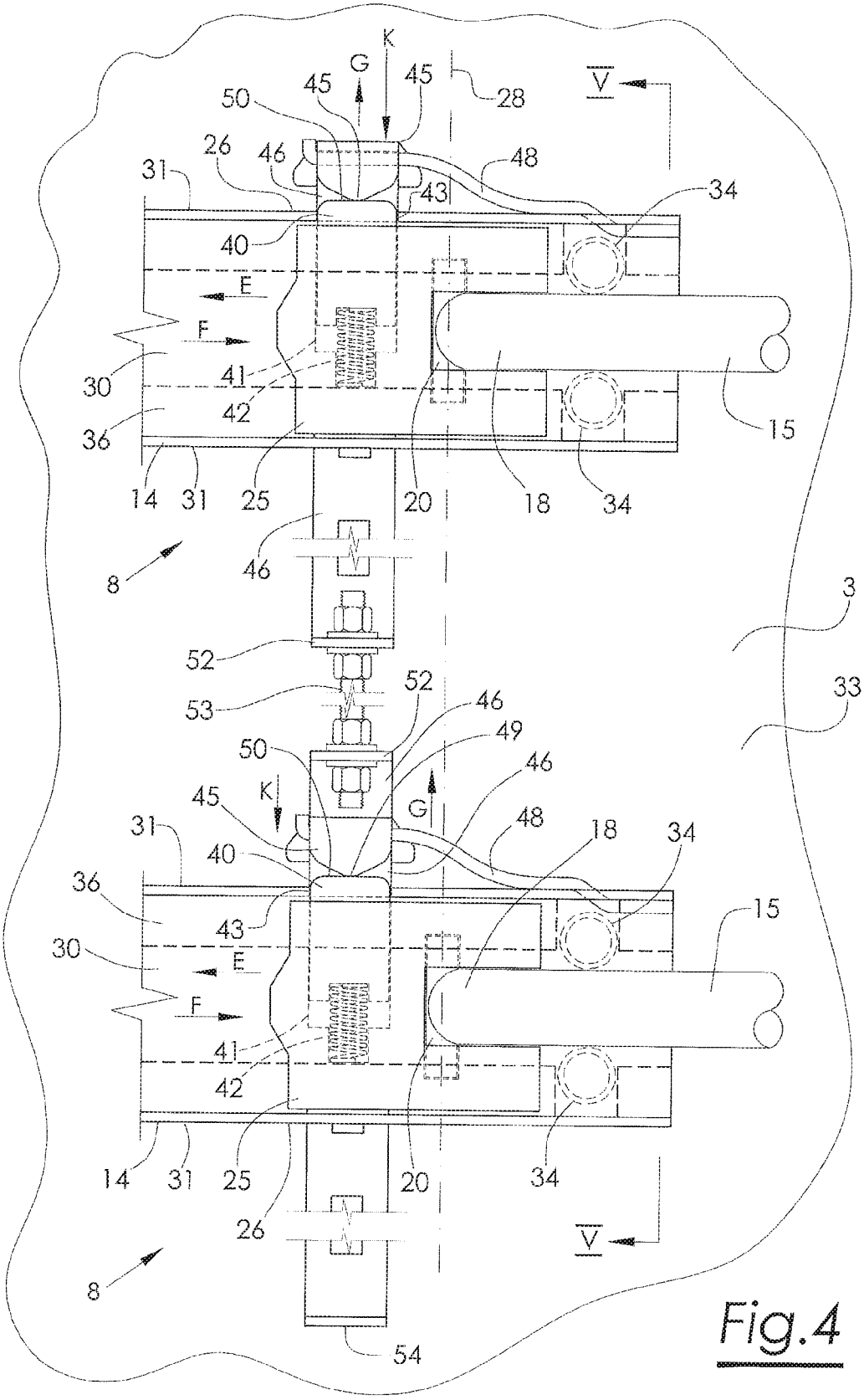
Figure 5:
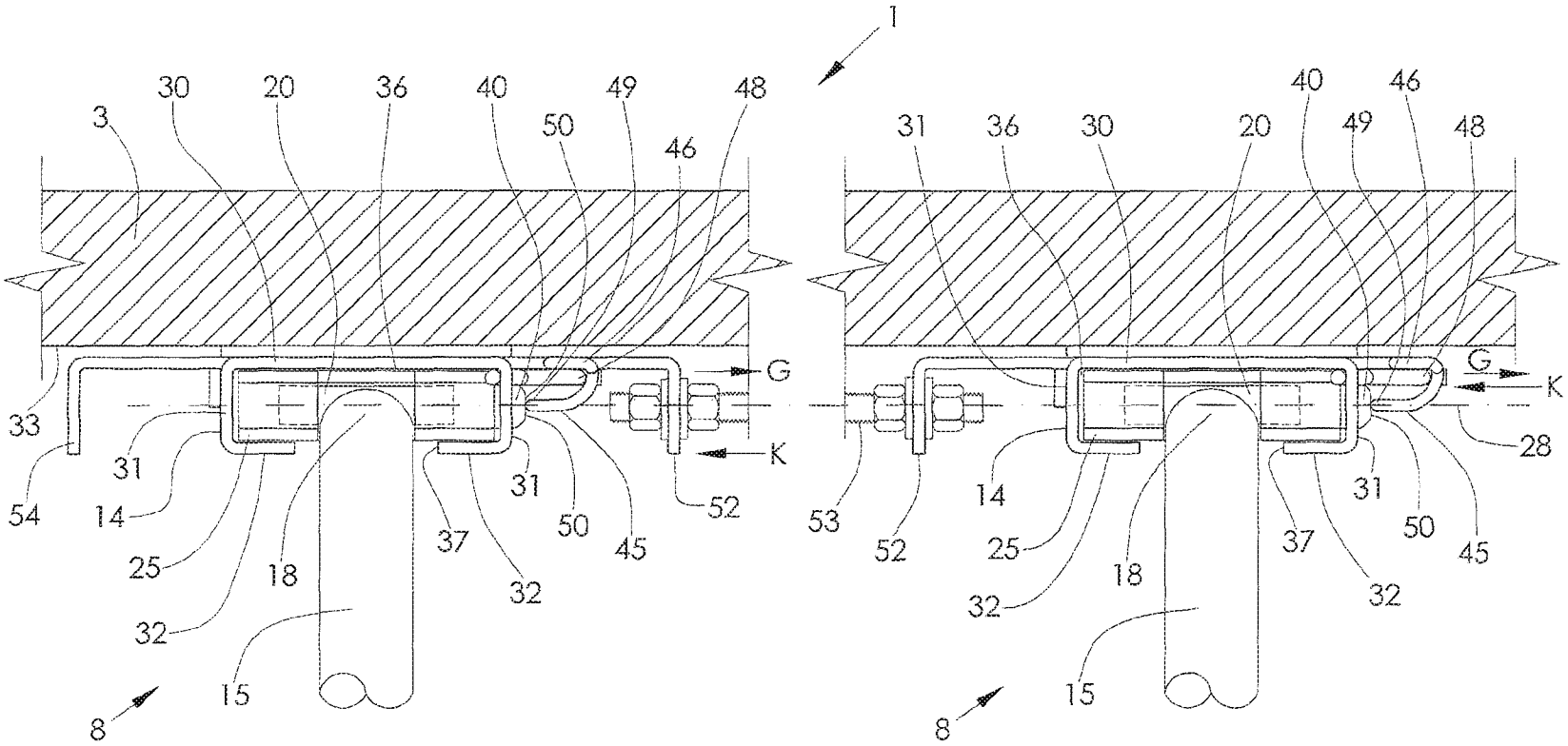
Figure 6:
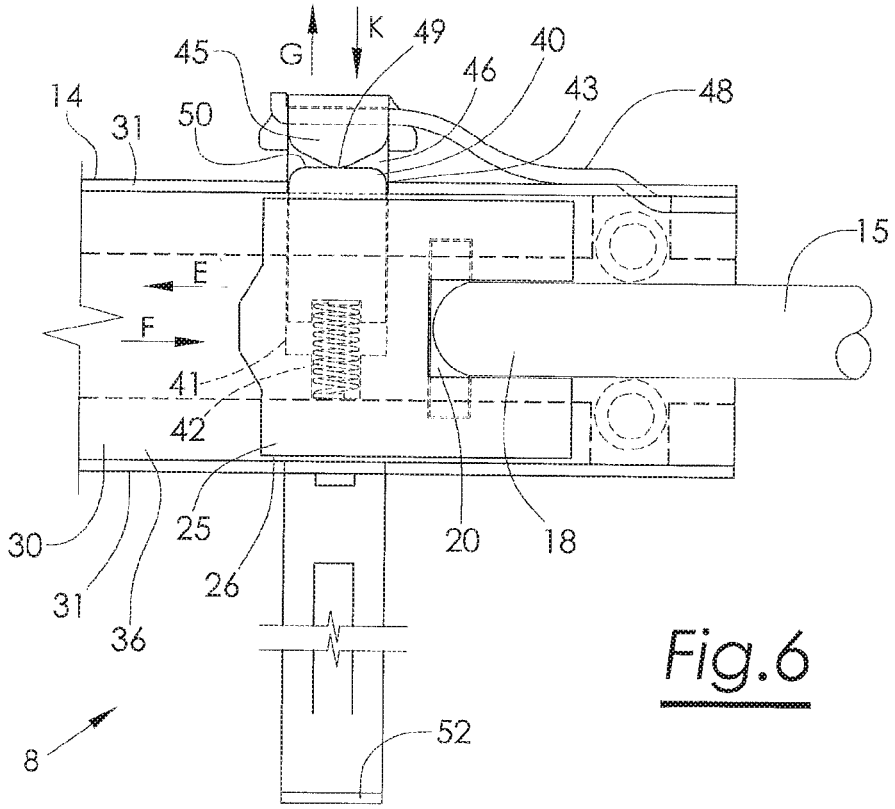
Figure 7:
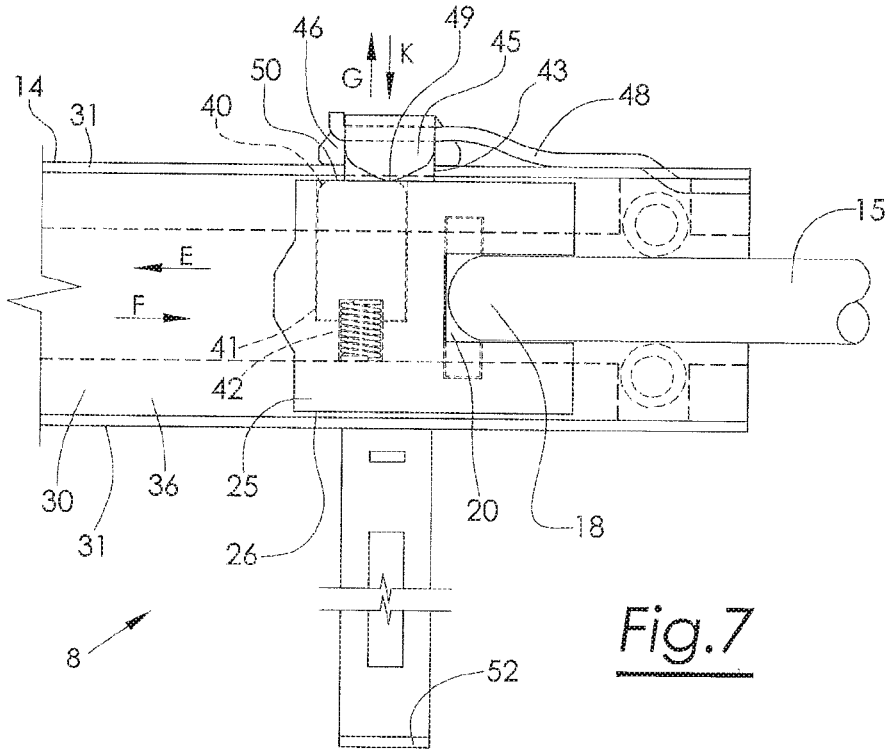
Figure 9:
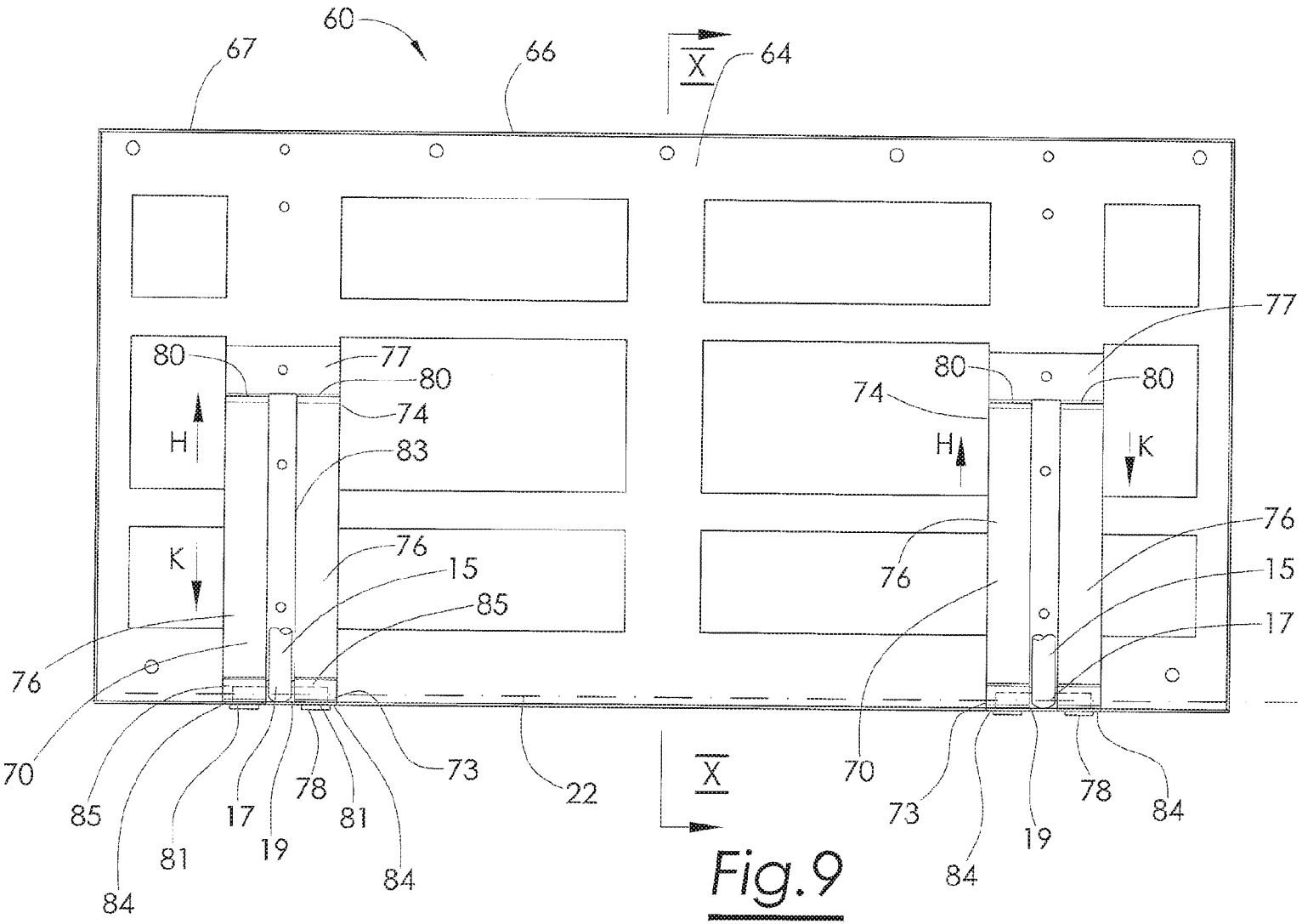
Figure 10:
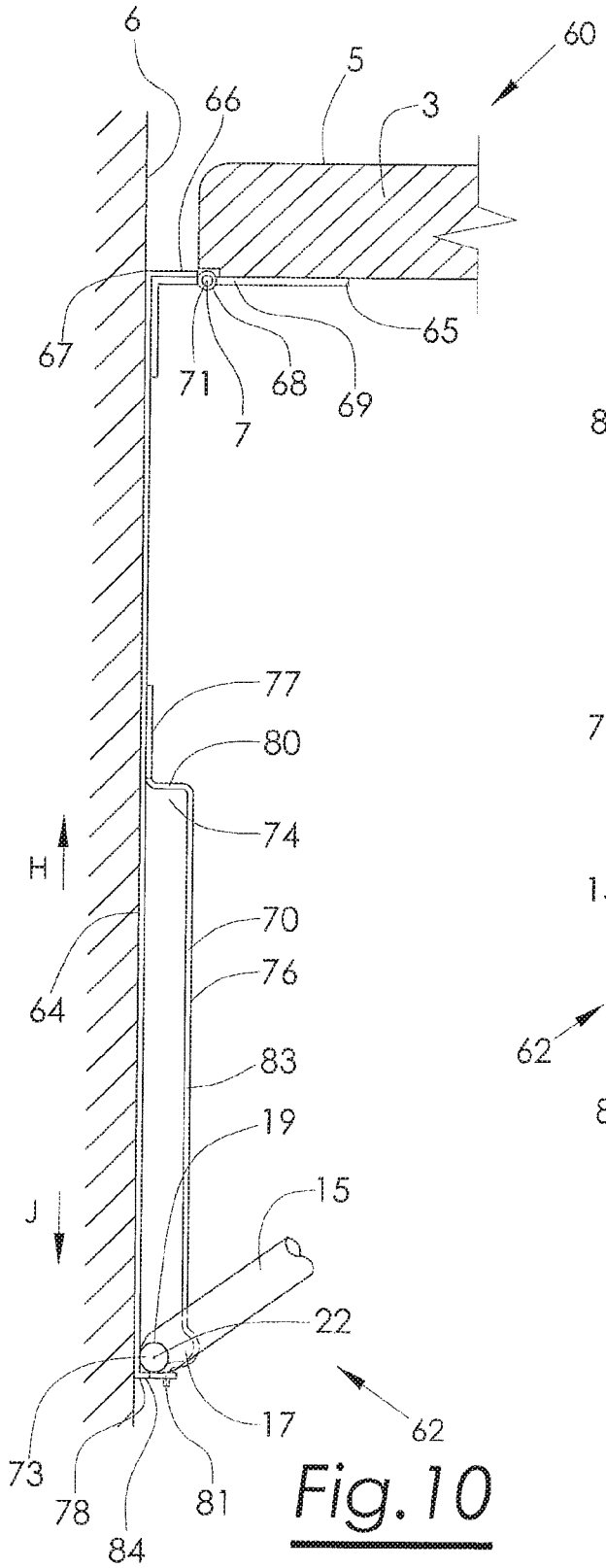
Figure 11:
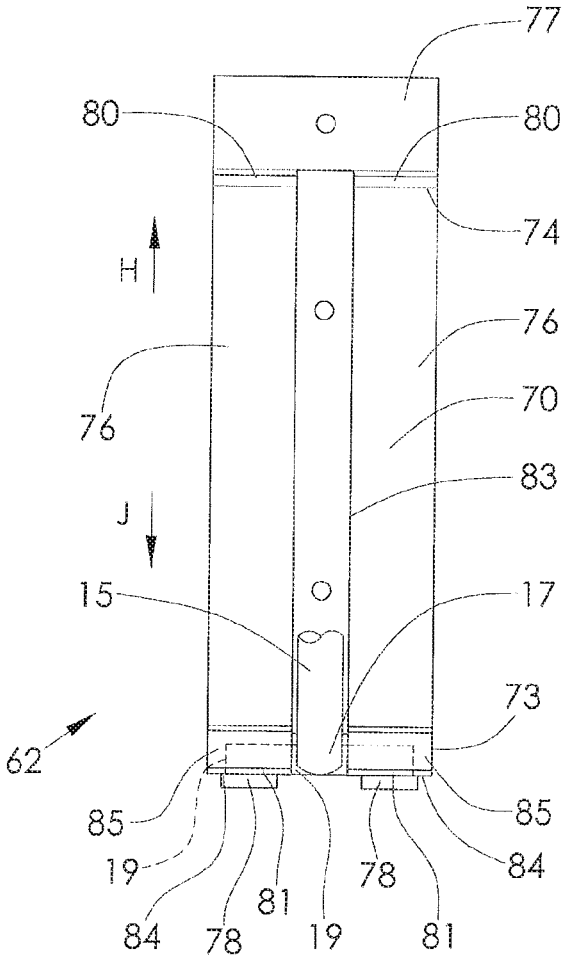
Figure 12:
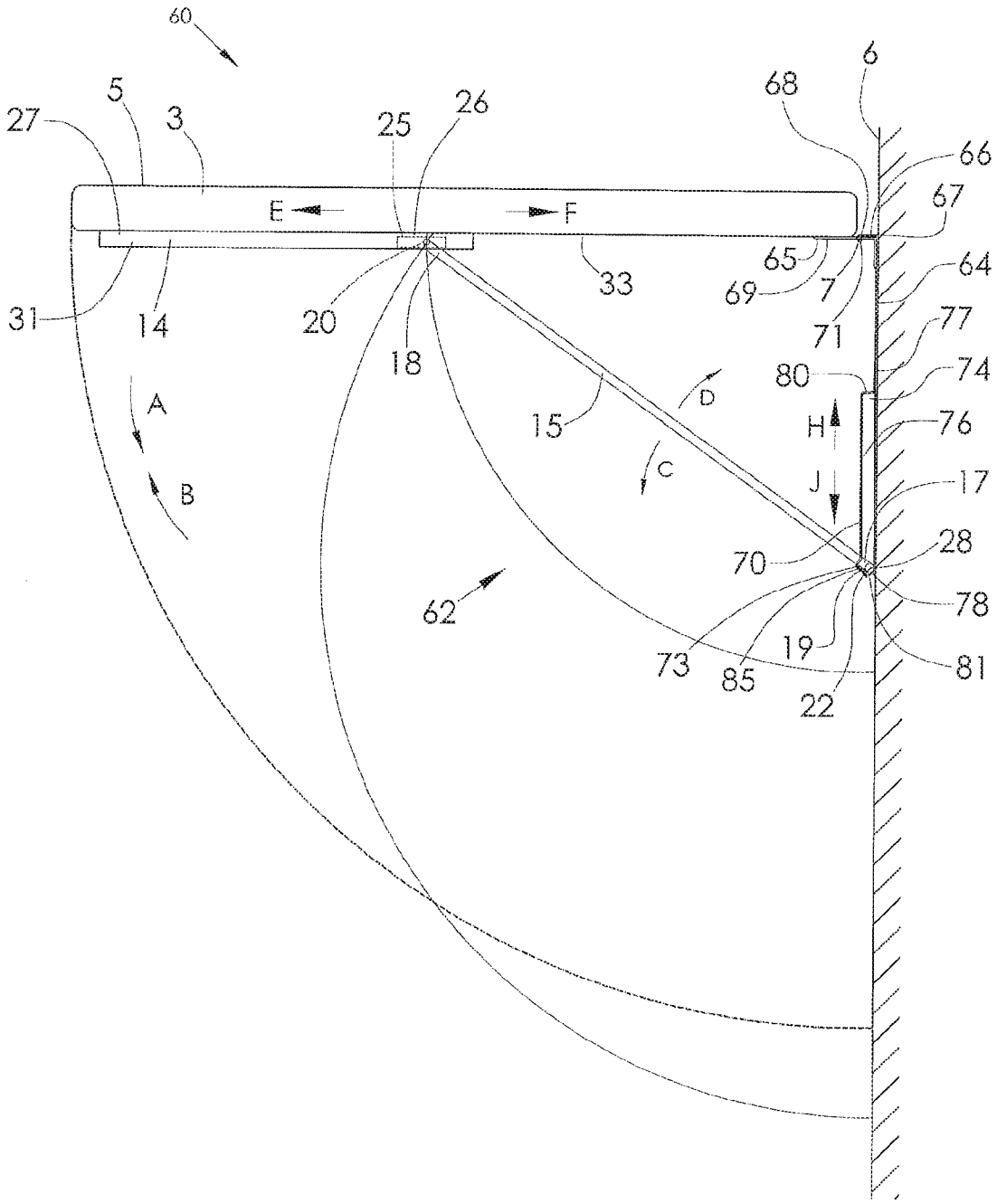
Figure 13:
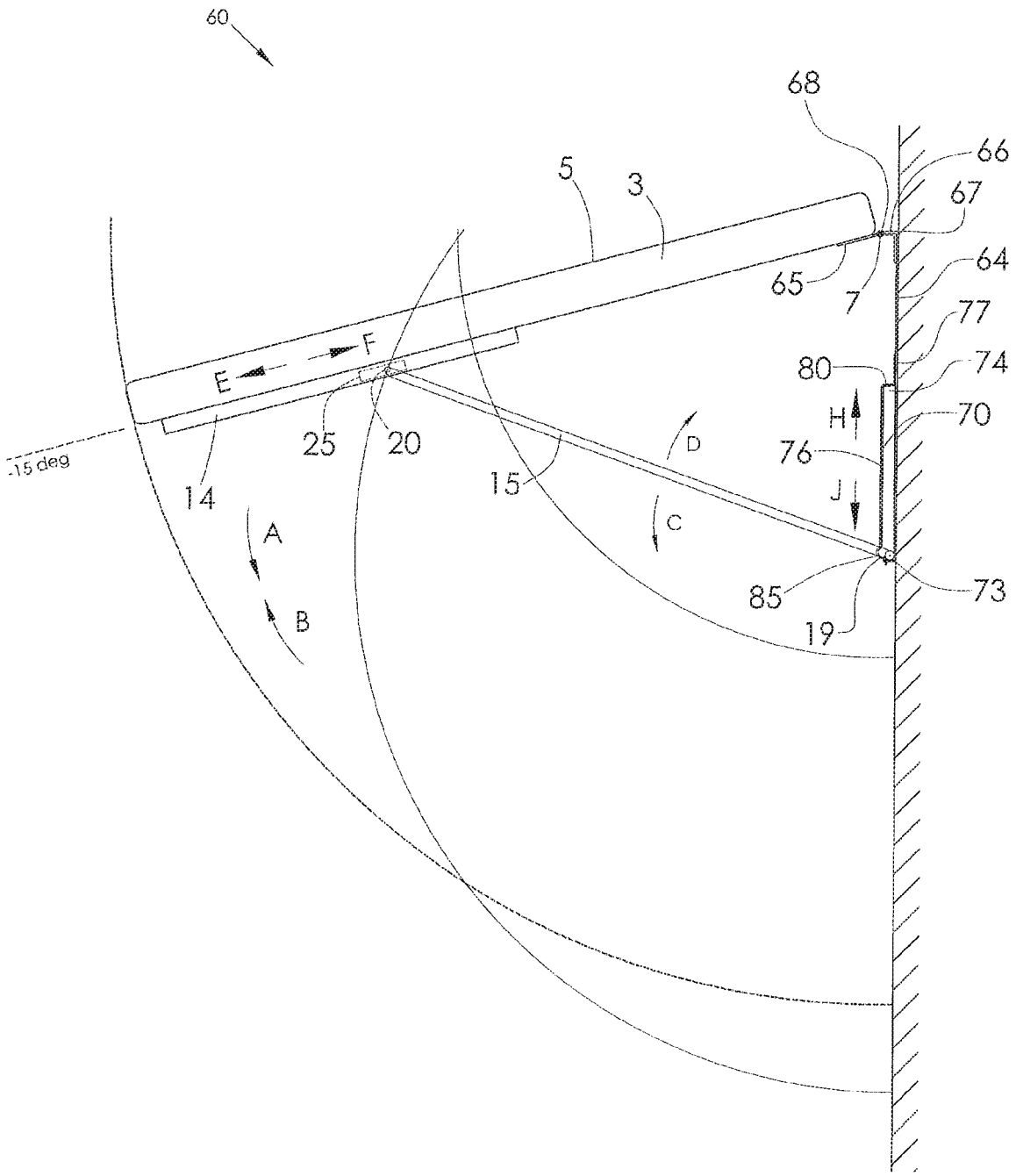
Figure 14:
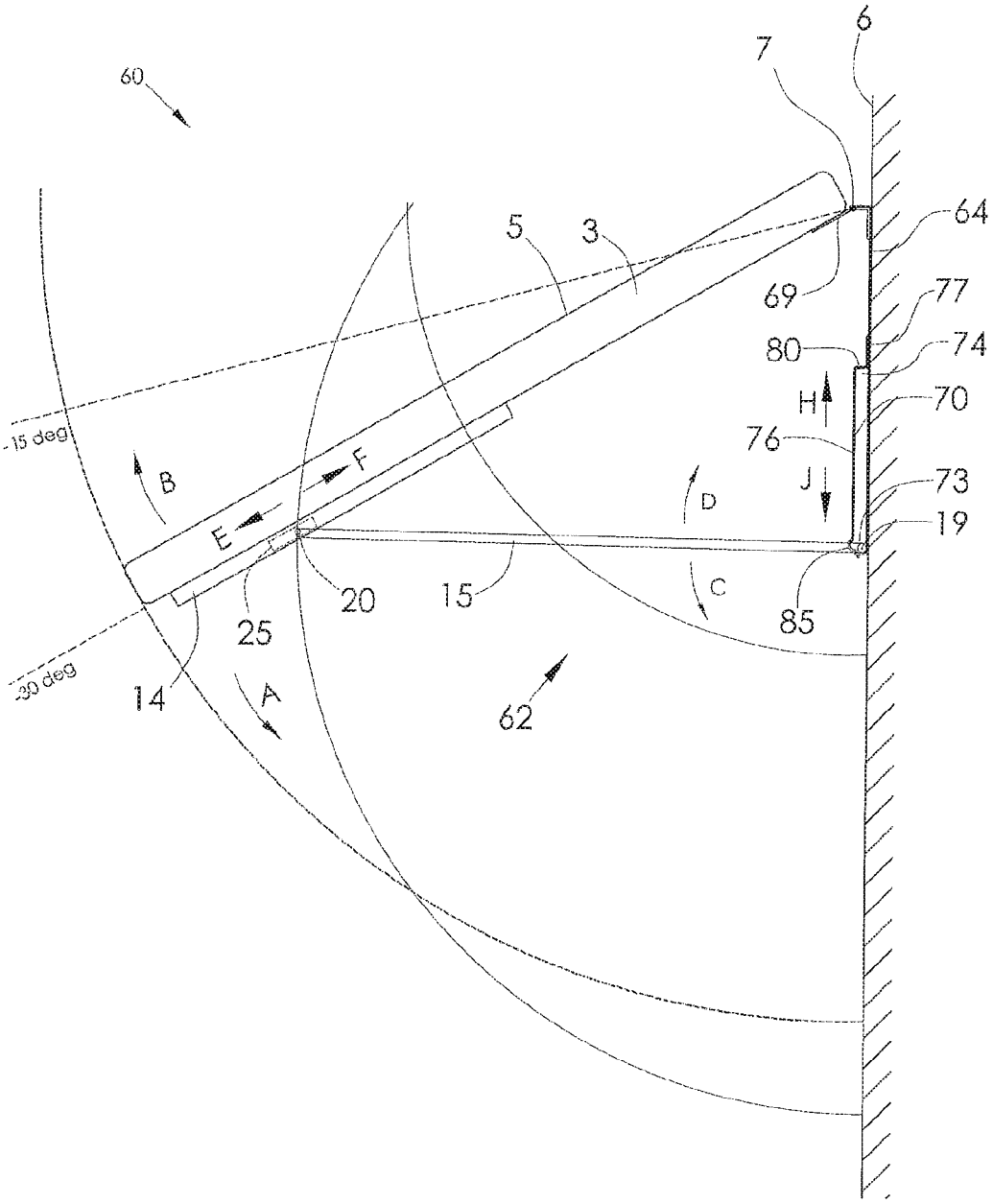
Figure 15:
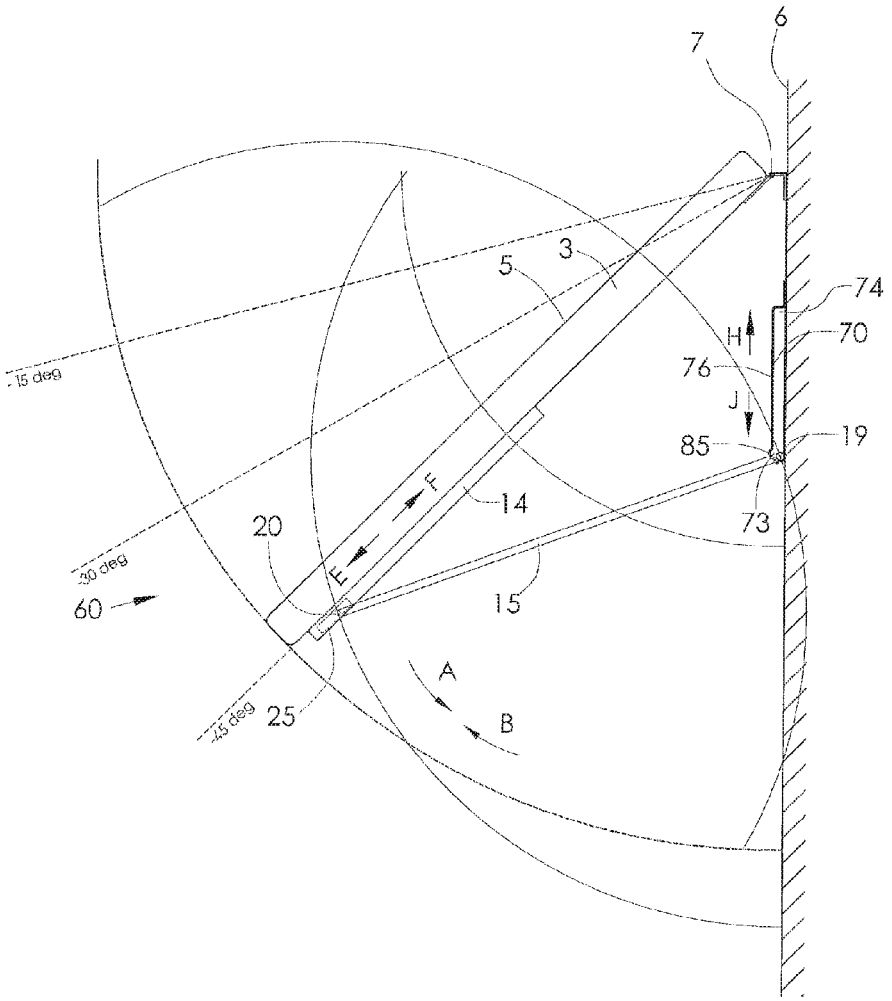
Figure 16:
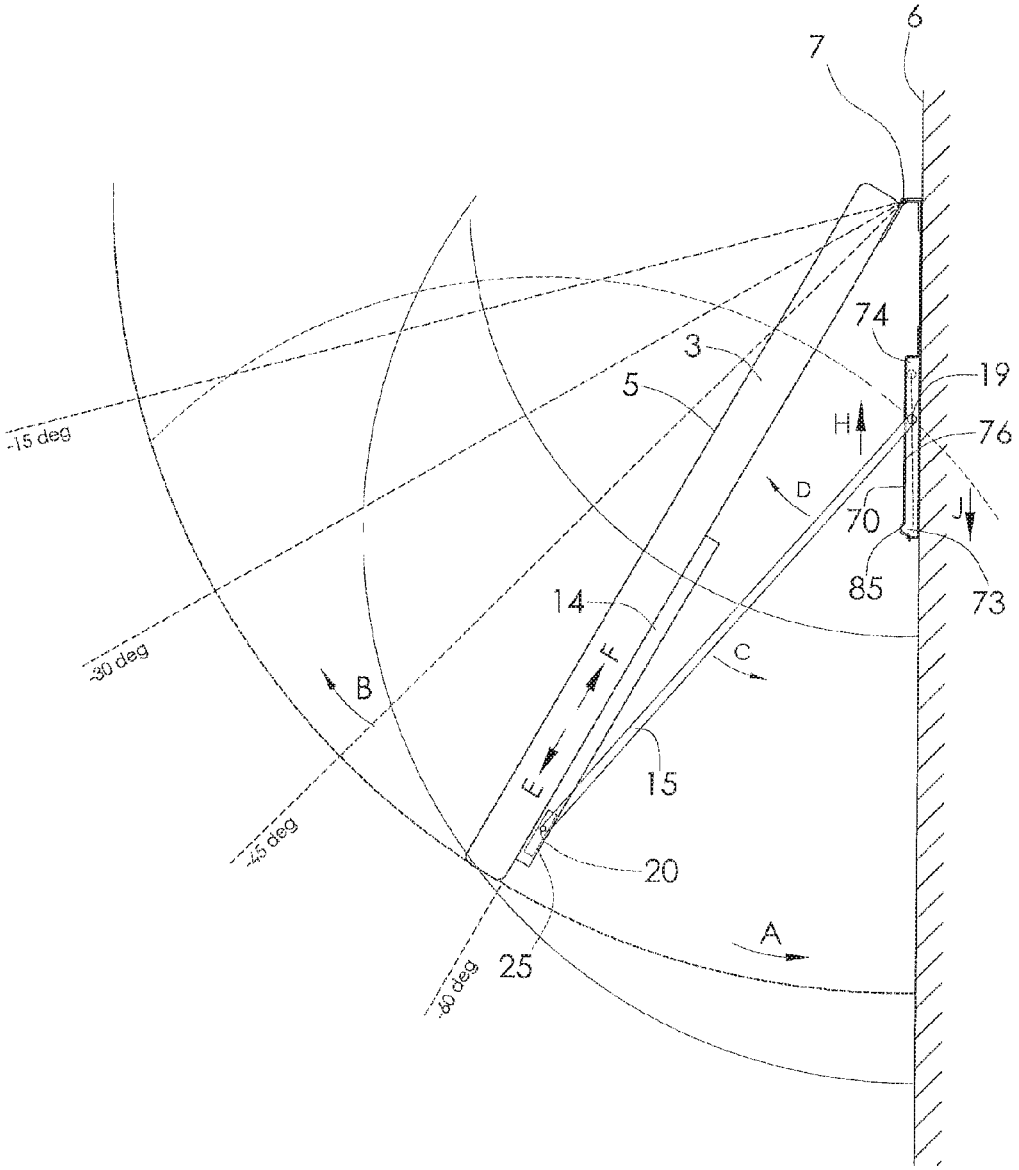
Figure 17:
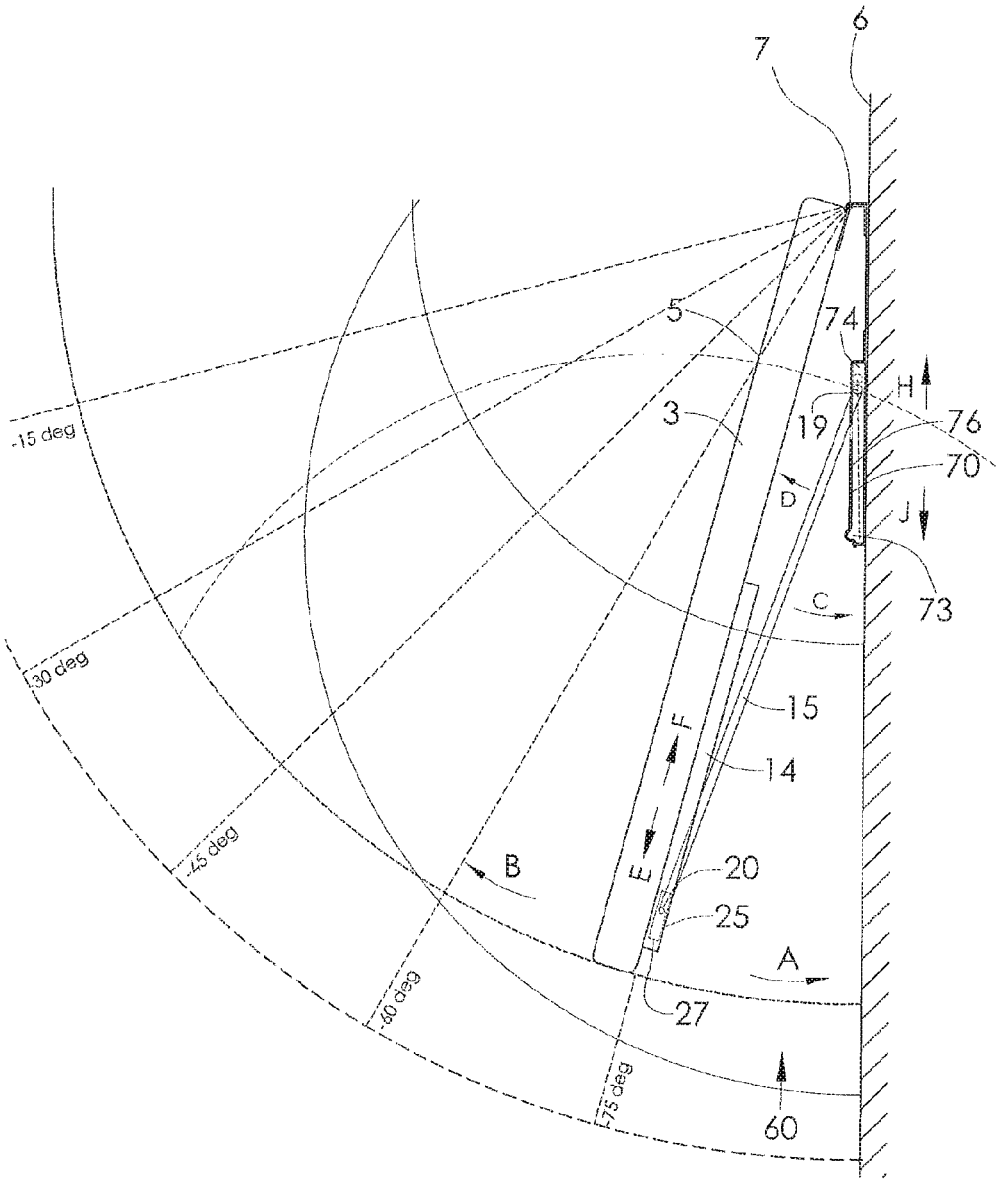
Figure 18:
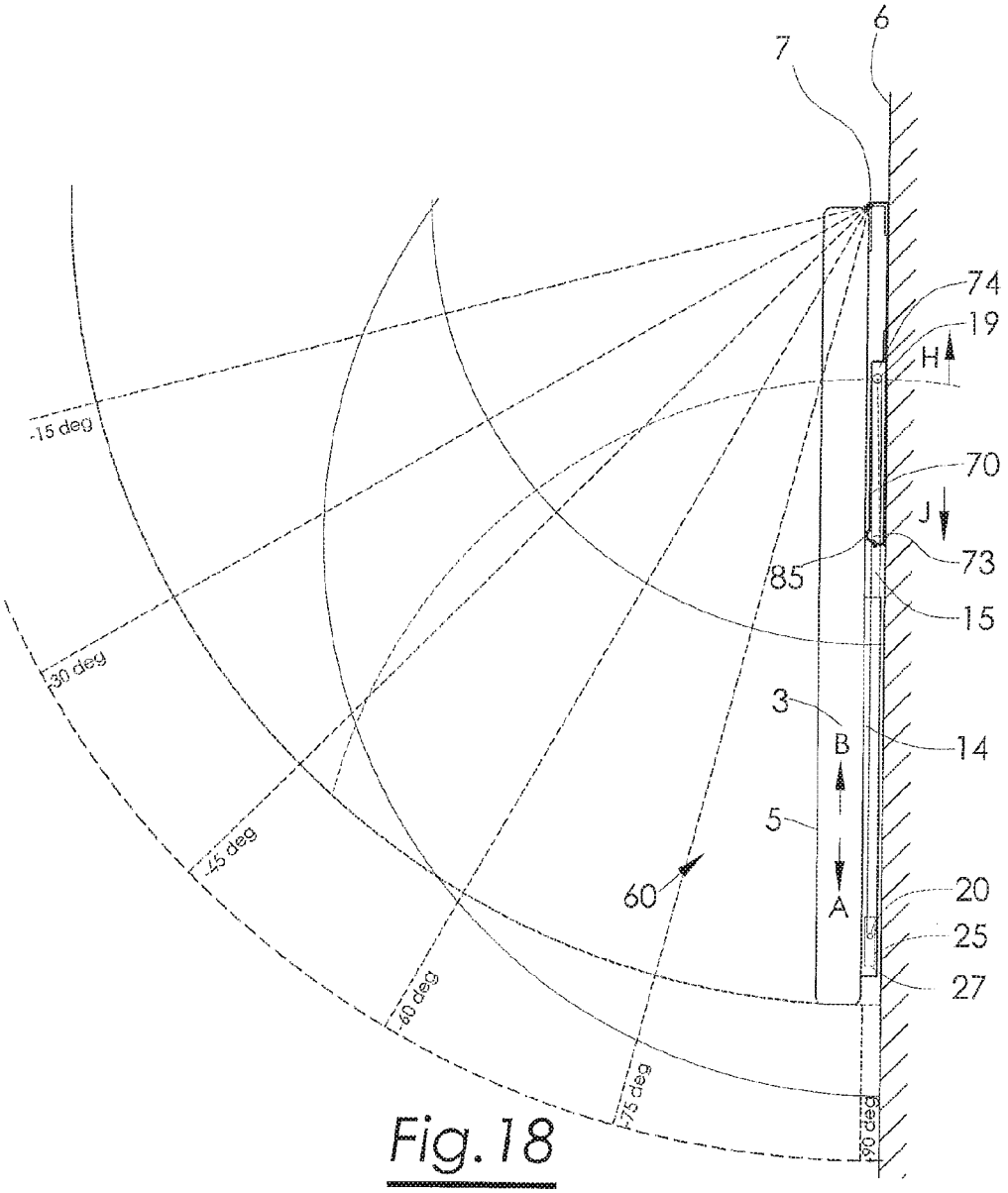
Figure 19:
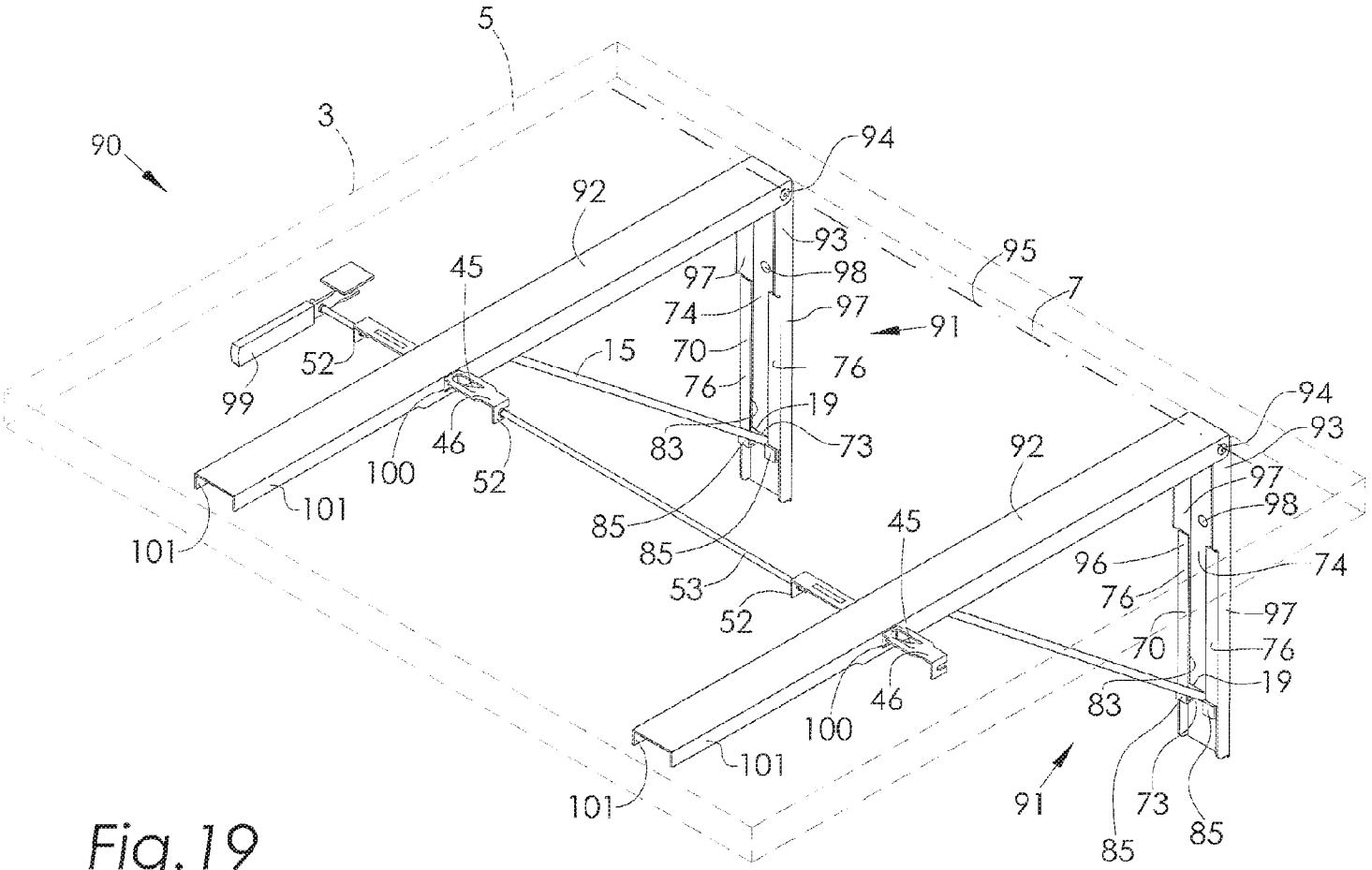
Figures 20, 25:
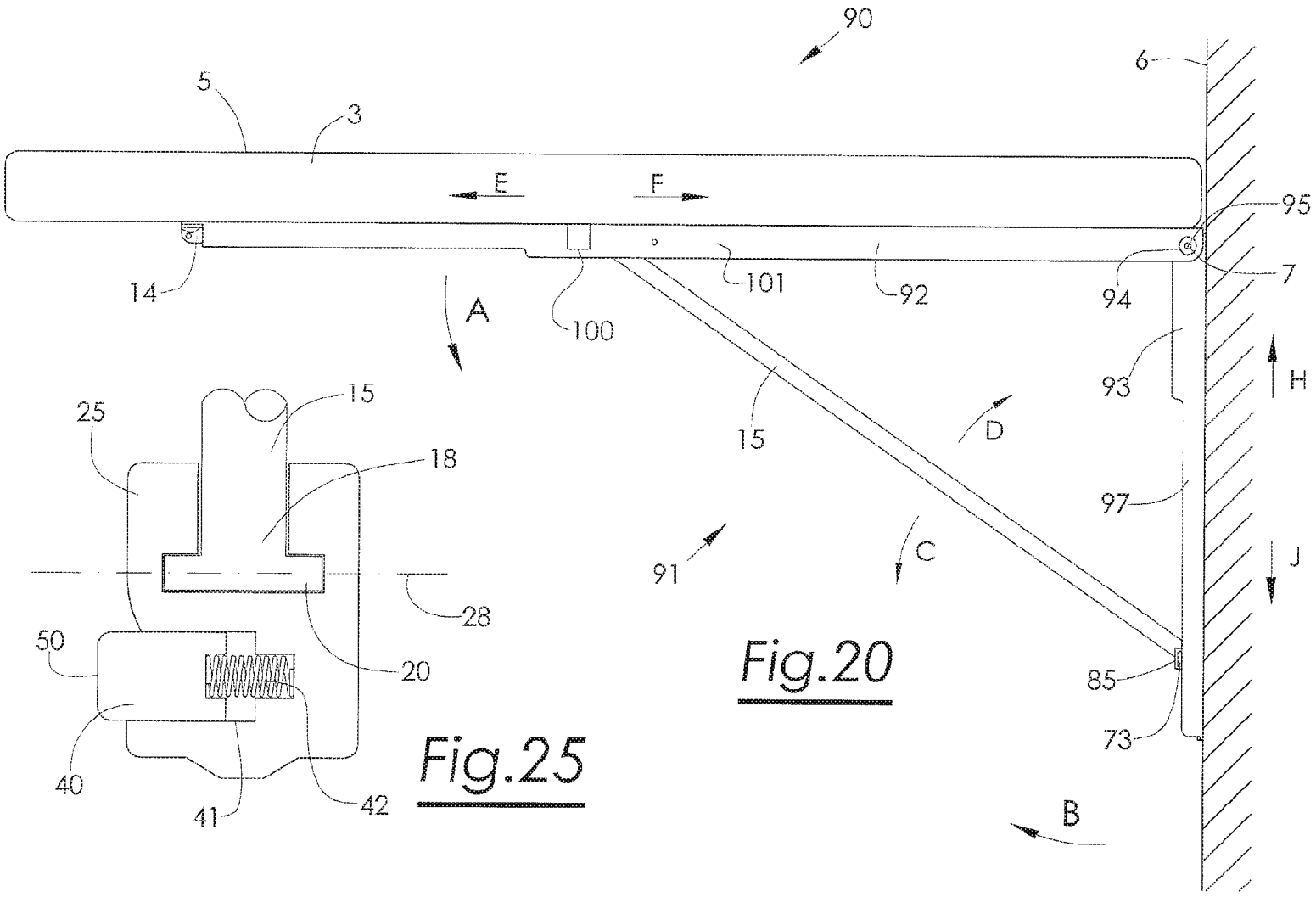
Figures 21, 26:
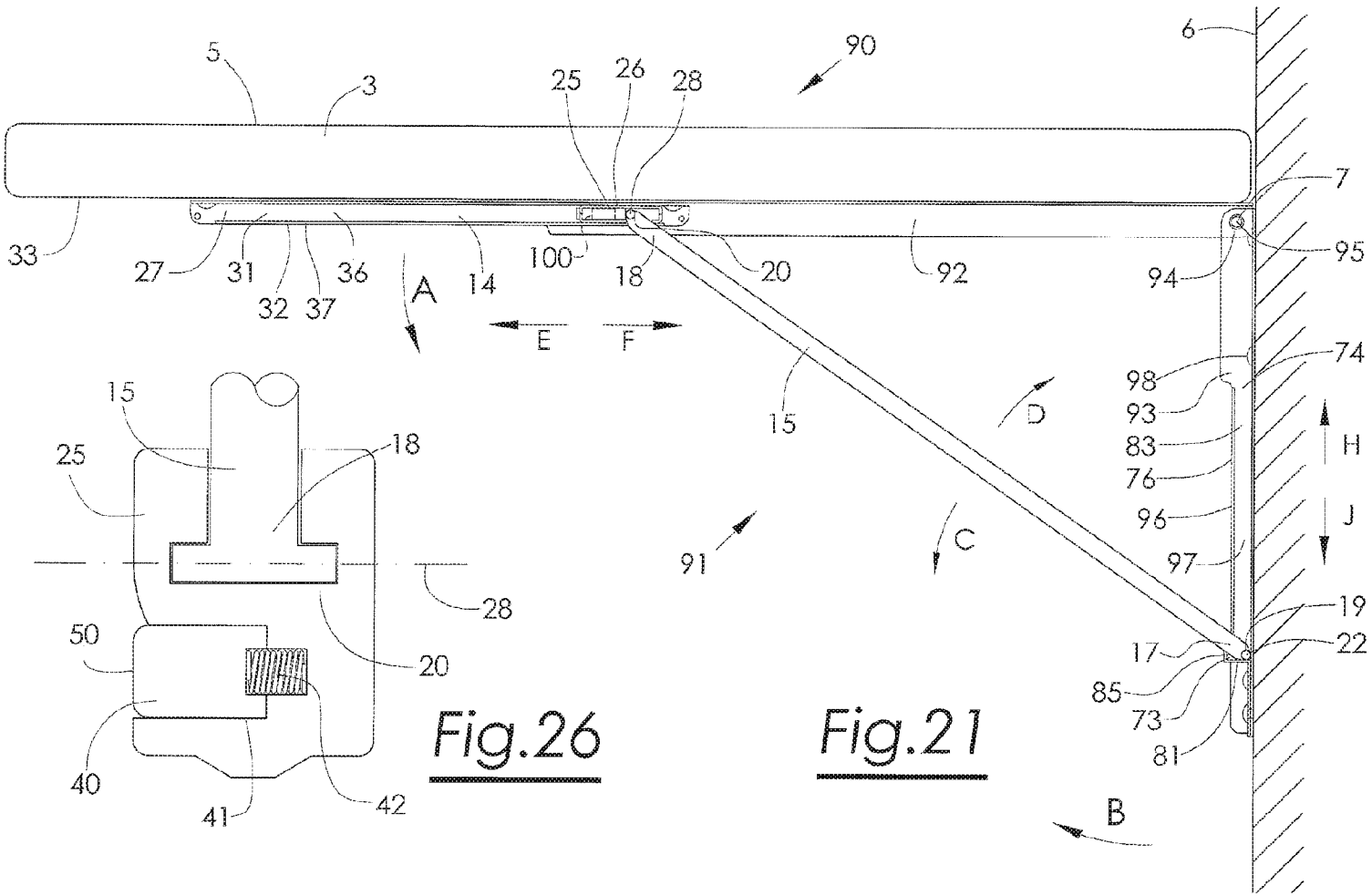
Figure 22:
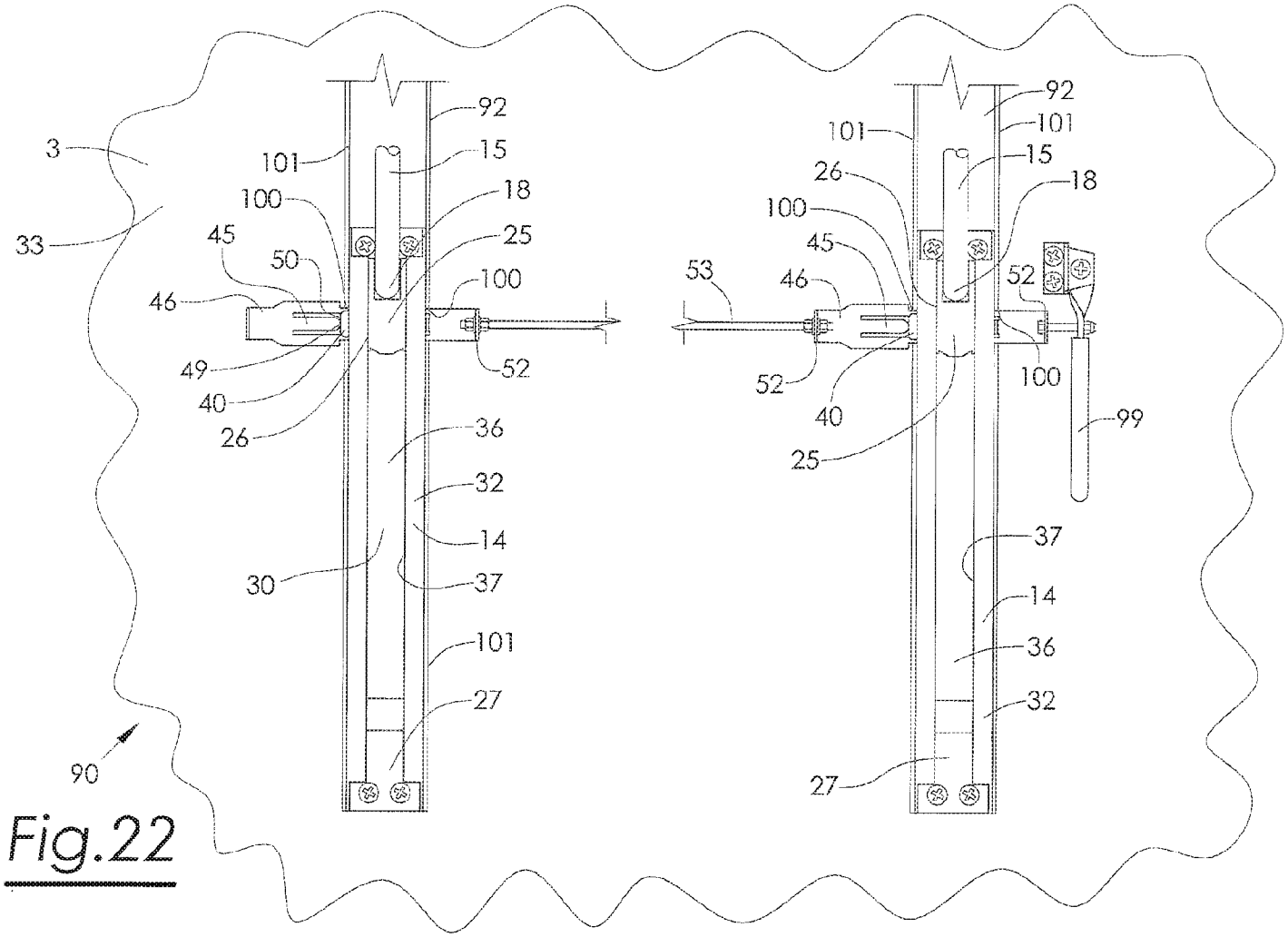
Figure 23:
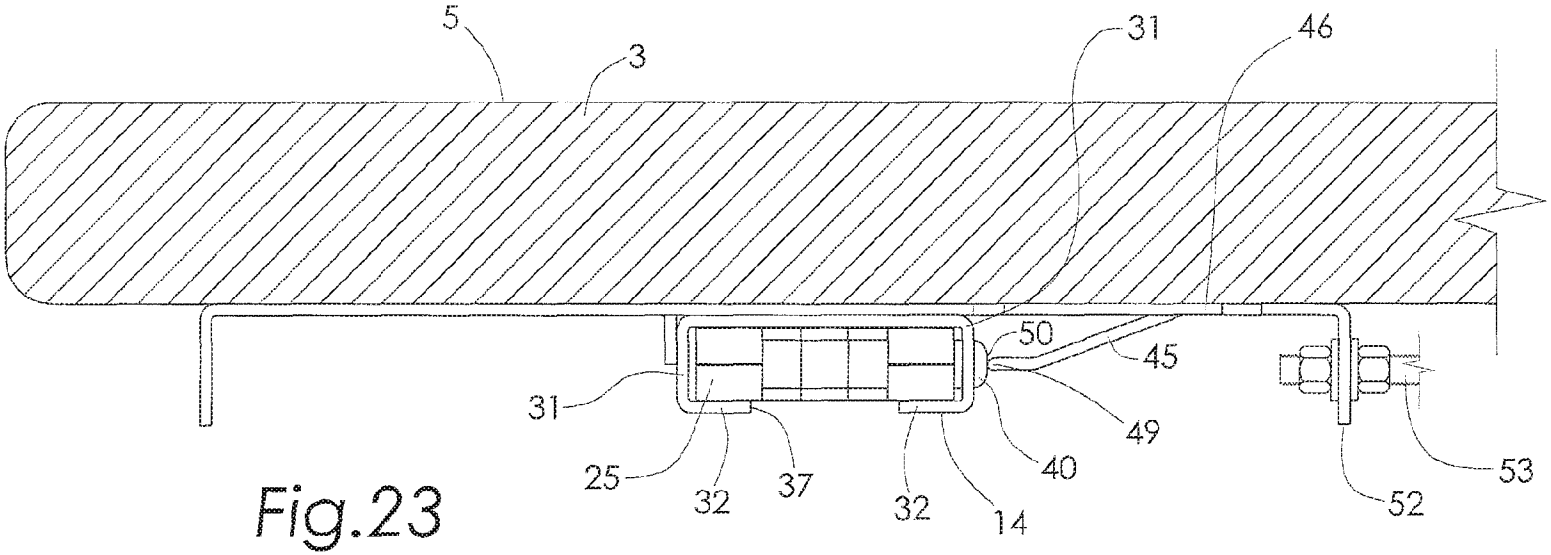
Figure 24:
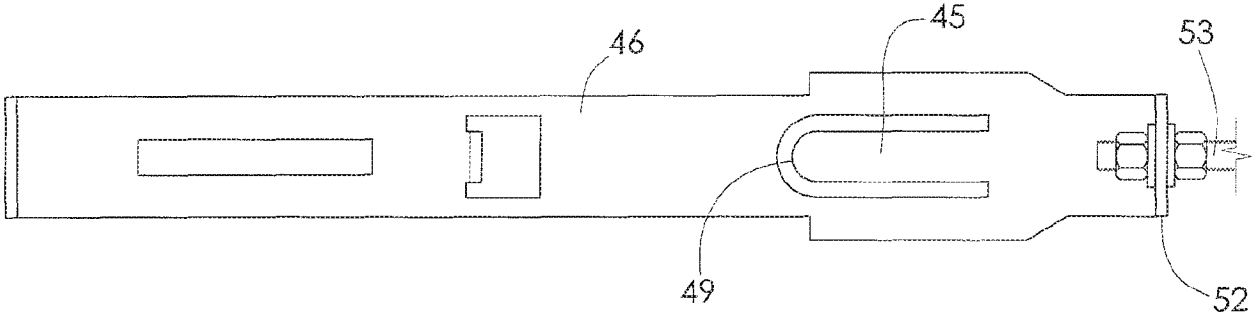

The invention will be more clearly understood from the following description of some preferred examples thereof, which are given by way of non-limiting example only, in which:

FIG. 1 is a side elevational view of a worktop according to the invention secured to a structure by a pair of support mechanisms also according to the invention, although only one of the support mechanisms can be seen in FIG. 1, FIG. 2 is a side elevational view of the worktop of FIG. 1 in a different state to that of FIG. 1, FIG. 3 is a cross-sectional side elevational view of a portion of one of the support mechanism of FIG. 1 illustrated supporting a portion of the worktop in the state of FIG. 1, FIG. 4 is an underneath cross-sectional plan view of portions of the support mechanisms of FIG. 1 on the line IV-IV of FIG. 3 supporting the worktop of FIG. 1, FIG. 5 is a cross-sectional end elevational view of the portions of the support mechanisms of FIG. 1 on the line V-V of FIG. 4 also supporting the worktop of FIG. 1, FIG. 6 is an underneath cross-sectional plan view of a portion of one of the support mechanism of FIG. 1 also on the line IV-IV of FIG. 3, FIG. 7 is a view similar to FIG. 6 of the portion of the support mechanism of FIG. 6 illustrating a part of the support mechanism in a different state, FIG. 8 is an end elevational view of the portion of the support mechanism of FIG. 6, FIG. 9 is a front elevational view of a portion of a support mechanism according to another embodiment of the invention for hingedly coupling a worktop also according to another embodiment of the invention to a structure, FIG. 10 is a cross-sectional side elevational view of the portion of the support mechanism of FIG. 9 on the line X-X of FIG. 9 illustrated supporting a portion of the worktop, FIG. 11 is an enlarged front elevational view of a portion of the support mechanism of FIG. 9, FIGS. 12 to 18 are side elevational views similar to FIG. 1 of the support mechanism of FIG. 9 hingedly coupling the worktop to a structure with the worktop and the support mechanism in respective different states, FIG. 19 is a perspective view of a worktop according to another embodiment of the invention supported on and hingedly coupled to a structure by a pair of support mechanisms also according to another embodiment of the invention, FIG. 20 is a side elevational view of the worktop of FIG. 19 and one of the support mechanisms of FIG. 19, FIG. 21 is a cross-sectional side elevational view of the worktop and one of the support mechanisms of FIG. 19, FIG. 22 is an underneath plan view of a portion of the worktop of FIG. 19, FIG. 23 is an end elevational view of a portion of the worktop and a portion of one of the support mechanisms of FIG. 19, FIG. 24 is an underneath plan view of a portion of one of the support mechanisms of FIG. 19, FIG. 25 is a cross-sectional plan view of a detail of the support mechanism of FIG. 19, and FIG. 26 is a view similar to that of FIG. 25 of the detail of FIG. 25 showing a portion of the detail of FIG. 25 in a different position.

Referring to the drawings, and initially to FIGS. 1 to 8 thereof, there is illustrated a worktop 1 according to the invention, indicated generally by the reference numeral 1, comprising a worktop leaf 3 having a work surface 5, hingedly coupled to a structure, in this embodiment of the invention a wall 6 about a hinge axis 7 by a pair of spaced apart support mechanisms also according to the invention and indicated generally by the reference numeral 8. The leaf 3 is hingeable about the hinge axis 7 in the directions of the arrows A and B between a usable state illustrated in full lines in FIG. 1 and in broken lines in FIG. 2 with the leaf 3 extending outwardly and substantially horizontally from the wall 6, and a folded state illustrated in full lines in FIG. 2 and in broken lines in FIG. 1 with the leaf 3 extending substantially vertically downwardly from the hinge axis 7 adjacent the wall 6, whereby the worktop 1 is folded away.

Each support mechanism 8 comprises a first mounting means, namely, a first mounting member 9, which is adapted to be secured to the wall 6, and is secured to the wall 6 by screws (not shown). A secondary member 10 is pivotally coupled to the first mounting member 9 of each support mechanism 8 by a main pivot pin 11 which defines a main pivot axis 12 about which the secondary member 10 is pivotal relative to the first mounting member 9. The first mounting members 9 of the respective support mechanisms 8 are secured to the wall 6 with the main pivot pins 11 of the respective support mechanisms 8 aligned with each other and the respective main pivot axes 12 defined by the respective main pivot pins 11 defining a common main pivot axis 12 about which the secondary members 10 are pivotal relative to the first mounting members 9. The secondary members 10 of the respective support mechanisms 8 are adapted to be secured to the leaf 3 and are secured to the leaf 3 by screws (not shown), so that the leaf 3 is hingedly coupled to the wall 6 about the common main pivot axis 12 which defines the hinge axis 7 about which the leaf 3 is hingeble between the usable state and the folded state.

A second mounting means of each support mechanism 8 comprising a second guide means, namely, an elongated second guide track 14 is adapted to be secured to the leaf 3, and is secured to the leaf 3 by screws (not shown). The support mechanisms 8 comprising the first mounting members 9 and the second guide tracks 14 are secured to the wall 6 and the leaf 3, respectively, at locations axially spaced apart from each other along the hinge axis 7, with the first mounting members 9 and the second guide tracks 14 of the respective support mechanisms 8 aligned with each other. With the first mounting members 9 of the respective support mechanisms 8 secured to the wall 6, the corresponding secondary members 10 secured to the leaf 3 and the second guide tracks 14 of the corresponding support mechanisms 8 also secured to the leaf 8, the second guide tracks 14 are pivotal about the hinge axis 7 relative to the first mounting members 9 with the leaf 3 in the directions of the arrows A and B between a support state illustrated in FIG. 1 supporting the leaf 3 in the usable state, and a rest state illustrated in FIG. 2 with the leaf 3 in the folded state and the respective support mechanisms 8 located between the wall 6 and the leaf 3.

An elongated rigid strut 15 of each support mechanism 8 extends between the first mounting member 9 and the second guide track 14 of the corresponding support mechanism 8. Each strut 15 extends between a first end 17 and a second end 18. The first end 17 of each strut 15 terminates in a first pivot pin 19, and the second end 18 of each strut 15 terminates in a second pivot pin 20. The first pivot pin 19 is pivotally engageable in a pivot bracket 21 located on the first mounting member 9 spaced apart downwardly from the hinge axis 7. The first pivot pin 19 of each strut 15 in the corresponding first pivot bracket 21 defines a first pivot axis 22 which extends parallel to the hinge axis 7, and about which the corresponding strut 15 is pivotal in the direction of the arrows C and D between a first state illustrated in full lines in FIG. 1 supporting the second guide track 14 of the corresponding support mechanism 8 in the support state, and in turn supporting the leaf 3 in the usable state, and a second state illustrated in full lines in FIG. 2 with the second guide track 14 of the corresponding support mechanism 8 in the rest state and the leaf 3 in the folded state. In this embodiment of the invention the first pivot axes 22 defined by the first pivot pins 19 of the respective support mechanisms 8 define a common first pivot axis. However, while this is preferable, it is not essential.

The second pivot pin 20 of each strut 15 is pivotally mounted in a slideable element 25 which is slideable longitudinally along the second guide track 14 in the directions of the arrows E and F between a first position 26 illustrated in FIG. 1 with the strut 15 of the corresponding support mechanism 8 in the first state, and a second position 27 illustrated in FIG. 2 with the strut 15 in the second state. The second guide track 14 guides the slideable element 25 between the first and second positions 26 and 27 in a direction perpendicular to the hinge axis 7. As the leaf 3 is being hinged from the folded state to the usable state and the second guide tracks 14 are in turn being pivoted from the rest state to the support state, the slideable elements 25 are urged from the second position 27 to the first position 26 in the direction of the arrow F towards the hinge axis 7. In other words, the first positions 26 of the slideable elements 25 of the support mechanisms 8 are closer to the hinge axis 7 than the second positions 27 of the slideable elements 25 in the second guide track 14. The second pivot pin 20 of each strut 15 is pivotal in the slideable element 25 of the corresponding support mechanism 8 about a second pivot axis 28 which extends substantially parallel to the hinge axis 7, so that as the strut 15 of each support mechanism 8 is pivoting between the first and second states, the second pivot pin 20 pivots about the second pivot axis 28 as the slideable element 25 is sliding between the first and second positions 26 and 27. In this embodiment of the invention the second pivot axes 28 of the respective support mechanisms 8 define a common second pivot axis as the slideable elements 25 slide simultaneously between the first and second positions 26 and 27. Although it is preferable that the second pivot axes 28 should define a common pivot axis as the slideable elements 25 slide between the first and second positions 26 and 27, this is not essential.

Each second guide track 14 comprises an elongated base wall 30 and a pair of opposite spaced apart parallel side walls 31 extending from and along the base wall 30. The side walls 31 of each second guide track 14 terminate in flanges 32 which extend inwardly towards each other and extend longitudinally parallel to and spaced apart from the base wall 30. The base wall 30 of each second guide track 14 is adapted for securing to an underside 33 of the leaf 3 by the screws (not shown) through screw accommodating holes 34. The base wall 30, the side walls 31 and the flanges 32 of each second guide track 14 together define a guide way 36 of the second guide track 14 within which the corresponding slideable element 25 is retained captive and is longitudinally slideable therein. The flanges 32 of each second guide track 14 define an elongated slot 37 extending longitudinally along the second guide track 14 for accommodating the corresponding strut 15 therethrough to the slideable element 25.

A retaining means for retaining the slideable element 25 in the first position 26 in the second guide track 14 of each support mechanism 8 with the second guide track 14 in the support state comprises a detent, namely, a spring loaded plunger 40 which is slideable in a bore 41 in the corresponding slideable element 25. Each spring loaded plunger is spring urged by a compression spring 42 in a direction outwardly of the bore 41 for engaging a receiving means, namely, a receiving opening 43 in one of the side walls 31 of the corresponding second guide track 14 adjacent the first position 26 of the slideable element 25 for in turn retaining the corresponding slideable element 25 in the first position 26 with the corresponding second guide track 14 in the support state.

A release means comprising an engagement member 45 is provided for each support mechanism 8 for urging the spring loaded plunger 40 into the bore 41 of the corresponding slideable element 25 against the action of the compression spring 42 in order to disengage the spring loaded plunger 40 from the corresponding receiving opening 43. The engagement member 45 of each support mechanism 8 is carried on a carrier element 46 which is slideably mounted on the corresponding second guide track 14 and is slideable transversely relative to the second guide track 14 in the directions of the arrows G and K. A leaf spring 48 which is secured to an adjacent side wall 31 of the corresponding second guide track 14 is engageable with the carrier element 46 and is configured to bias the carrier element 46 in the direction of the arrow G, and in turn the engagement member 45 in the direction of the arrow G away from the corresponding spring loaded plunger 40. Urging the engagement member 45 in the direction of the arrow K into engagement with the spring loaded plunger 40, urges the spring loaded plunger 40 into the bore 41 in the corresponding slideable element 25 for disengaging the spring loaded plunger 40 from the corresponding receiving opening 43.

Each engagement member 45 tapers to an engagement tip 49 which engages an end face 50 of the adjacent spring loaded plunger 40. The tapering engagement tips 49 provide a lead-in, so that a portion of the side wall 31 adjacent the corresponding receiving opening 43 does not engage the engagement member 45 until the spring loaded plunger 40 has been urged into the bore 41 of the corresponding slideable element 25 by the engagement member 45, and is engaged by the adjacent portion of the side wall 31 and retained captive in the bore 41 by the side wall 31 of the corresponding second guide track 14, as movement of the corresponding slideable element 25 from the first position 26 towards the second position 27 commences in the direction of the arrow E.

In this embodiment of the invention a connecting means, comprising connecting elements 52 which are connected to the carrier elements 46, and a linkage member, in this case a threaded rod 53 coupling the connecting elements 52 couple the carrier element 46 of the support mechanisms 8 together for facilitating simultaneous operation of the engagement members 45 for simultaneously disengaging the spring loaded plungers 40 from the corresponding receiving openings 43. A thumb and finger grip 54 is provided at the end of one of the connecting elements 52 adjacent an edge of the leaf 3 for gripping thereof for manual operation of the engagement members 45 for disengaging the spring loaded plungers 40 from the corresponding receiving openings 43.

In use, with the first mounting members 9 of the support mechanisms 8 secured to the wall 6, and with the secondary members 10 and the second guide tracks 14 of the support mechanisms 8 secured to the leaf 3, the leaf 3 is hingedly coupled to the wall 6 about the common main pivot axis 12, which defines the hinge axis 7, and the leaf 3 and the support mechanisms 8 are ready for use.

When it is desired to pivot the leaf 3 from the folded state into the usable state with the working surface 5 facing upwardly, the leaf 3 is pivoted about the hinge axis 7 in a generally upwardly direction, namely, in the direction of the arrow B. As the leaf 3 is being pivoted generally upwardly in the direction of the arrow B from the folded state to the usable state, the second guide tracks 14 pivot relative to the first mounting members 9 about the hinge axis 7 also in the direction of the arrow B from the rest state to the support state, the struts 15 pivot about the first pivot axes 22 in the direction of the arrow D from the second state to the first state, and the slideable elements 25 slide along the second guide tracks 14 in the direction of the arrow F from the second positions 27 to the first positions 26 with the second pivot pins pivoting in the slideable elements 25 about the second pivot axes 28. On the slideable elements 25 reaching the first positions 26, the spring loaded plungers 40 snap into engagement with the corresponding receiving openings 43 in the adjacent side walls 31 of the second guide tracks 14 under the outward urging action of the compression springs 42. The spring loaded plungers 40 engaged in the receiving openings 43 retain the slideable elements 25 in the first positions 26 in the second guide tracks 14 of the support mechanisms 8 and in turn retain the second guide tracks 14 in the support state with the second guide tracks 14 supported in the support state, and in turn, the leaf 3 supported in the usable state by the struts 15, with the working surface 5 extending generally horizontally and facing generally upwardly.

When the worktop 1 is no longer required, and it is desired to fold the worktop 1 away, the finger grip 54 of the corresponding connecting element 52 is gripped by hand and is urged in the direction of the arrow K for urging the engagement members 45 in the direction of the arrow K into engagement with the respective spring loaded plungers 40 in order to disengage the spring loaded plungers 40 from the corresponding receiving openings 43. With the spring loaded plungers 40 urged into the bores 41 of the slideable elements 25 and disengaged from the receiving openings 43, the leaf 3 is pivoted downwardly about the hinge axis 7 in the direction of the arrow A with the spring loaded plungers 40 engaged by adjacent portions of the adjacent side walls 31 of the corresponding second guide tracks 14 and retained captive in the bores 41 of the corresponding slideable elements 25. As the leaf 3 is pivoted downwardly in the direction of the arrow A from the usable state to the rest state, the slideable elements 25 slide along the second guide tracks 14 in the direction of the arrow E from the first positions 26 to the second positions 27 with the struts 15 pivoting in the direction of the arrow C from the first state to the second state until the leaf 3 is pivoted into the folded state. In the folded state, the leaf 3 depends downwardly from the hinge axis 7 parallel with the wall 6 with the support mechanisms 8 located between the leaf 3 and the wall 6.

Referring now to FIGS. 9 to 18, there is illustrated a worktop according to another embodiment of the invention, indicated generally by the reference numeral 60. The foldable worktop 60 is substantially similar to the foldable worktop 1, and similar components are identified by the same reference numerals. The foldable worktop 60 comprises a leaf 3 similar to the leaf 3 of the worktop 1 described with reference to FIGS. 1 to 8. The leaf 3 is hingedly coupled to a wall 6 about a hinge axis 7, and is hingeable between a usable state illustrated in FIG. 12 and a folded state illustrated in FIG. 18. In this embodiment of the invention the first mounting members of the support mechanisms 62 are formed on a common mounting plate 64 which is secured to the wall 6 by screws (not shown). A transversely extending secondary member 65 extends substantially the width of the mounting plate 64 and is pivotally coupled by a main pivot pin 68 to a transversely extending carrier member 66 which also extends transversely substantially the width of the mounting plate 64 along a top edge 67 thereof, and outwardly therefrom. The main pivot pin 68 defines a main pivot axis 71 about which the secondary member 65 is pivotal relative to the carrier member 66. The secondary member 65 is secured to the leaf 3 by screws (not shown). The combination of the secondary member 65, the carrier member 66 and the main pivot pin 68 essentially form an elongated piano hinge 69 by which the leaf 3 is hingedly coupled to the wall 6 with the main pivot axis 71 defining the hinge axis 7 about which the leaf 3 is hingedly coupled to the wall 6.

In this embodiment of the invention, instead of the first mounting means of each support mechanism 62 being provided by a first mounting member, which pivotally mounts the first pivot pin 19 of the corresponding strut 15 in a fixed pivot bracket 21, the first mounting means of each support mechanism 62 comprises a first guide means, namely, an elongated first guide track 70. Each first guide track 70 is mounted on the common mounting plate 64 at spaced apart locations which are axially spaced apart relative to the hinge axis 7. The first guide track 70 of each support mechanism 62 slideably and pivotally engages the first pivot pin 19 of the corresponding strut 15, so that as the strut 15 is pivoting between the first and second states, the first pivot pin 19 of the strut 15 of each support mechanism is also slideable between a first position 73 and a second position 74 as the leaf 3, and in turn the second guide track 14 are being hinged about the hinge axis 7 between the respective usable and support states and the respective folded and rest states. Each first guide track 70 comprises a pair of spaced apart elongated guide members 76 which extend between an upper connecting member 77 and a lower connecting member 78, which are secured to the mounting plate 64. Each guide member 76 is connected to the upper connecting member 77 by a corresponding upper spacer leg 80, and to the lower connecting member 78 by a corresponding lower spacer leg 81. The upper and lower spacer legs 80 and 81 space the guide members 76 from the mounting plate 64 for accommodating sliding and pivoting movement of the first pivot pin 19 between the guide members 76 and the mounting plate 64.

The guide members 76 of each first guide track 70 define a longitudinally extending guide slot 83 through which the corresponding strut 15 is accommodated to the first pivot pin 19. Each first guide track 70 slideably accommodates the corresponding first pivot pin 19 in the directions of the arrows H and J between the first position 73 illustrated in FIG. 12 and the second position at 74 illustrated in FIG. 18. The lower spacer legs 81 of the first guide track 70 of each support mechanism 62 act as an abutment means, namely, an abutment 84 for locating the first pivot pin 19 of the corresponding strut 15 in the first position in the corresponding first guide track 70. The guide slots 83 of the first guide tracks 70 extend longitudinally in directions perpendicular to the hinge axis 7, and slideably guide first pivot pins 19 of the struts 15 in a direction perpendicular to the hinge axis 7, as the first pivot pins 19 are sliding in the directions of the arrows H and J between the first and second positions 73 and 74. The first position 73 of the first pivot pin 19 is more remote from the hinge axis 7 than the second position 74 of the first pivot pin 19.

The guide members 76 of each first guide track 70 are slightly bulbous at 85 adjacent the lower spacer legs 81 in order to releasably locate and retain the first pivot pin 19 of the corresponding strut 15 in the first position 73 as the slideable element 25 is sliding in the second guide track 14 in the direction of the arrow F from the second position 27 to the first position 26 during hinging of the leaf 3 in the direction of the arrow B from the folded state to the usable state, as will be described below. The first pivot pins 19 are pivotal about the corresponding first pivot axes 22, as the first pivot pins 19 are sliding between the first and second positions 73 and 74 in the first guide tracks 70, and also while the first pivot pins 19 are releasably located and retained in the bulbous portions 85 of the respective first guide tracks 70.

The second guide tracks 14 and the corresponding slideable elements 25 of the support mechanisms 62 of this embodiment of the invention are similar to the second guide tracks 14 of the support mechanisms 8 of FIGS. 1 to 8.

In use, operation of the worktop 60 between the usable state and the folded state is substantially similar to that already described with reference to the worktop 1 of FIGS. 1 to 8, the only difference being that as the leaf 3 of the worktop 60 is being hinged about the hinge axis 7 between the usable state and the folded state, the first pivot pins 19 slide in the first guide tracks 70 between the first positions 73 and the second positions 74. To operate the worktop 60 from the usable state to the folded state, the engagement members 45, which are not illustrated in FIGS. 9 to 18, but which are similar to the engagement members 45 of the support mechanisms 8 of FIGS. 1 to 8, are operated simultaneously to release the plungers 40, which are also not shown in FIGS. 9 to 18, but which are similar to the plungers 40 of the support mechanisms 8 of FIGS. 1 to 8. The leaf 3 is then hinged downwardly about the hinge axis 7 in the direction of the arrow A, and the slideable elements 25 slide along the second guide tracks 14 in the direction of the arrow E from the first position 26 to the second position 27. After the slideable elements 25 commence sliding along the second guide tracks 14 from the first positions 26, the first pivot pins 19 commence to slide from the first positions 73 in the corresponding first guide tracks 70 in the direction of the arrow H to the second positions 74 therein. The slideable elements 25 continue to slide in the second guide tracks 14 until they reach the second position 27, and the first pivot pins 19 continue to slide in the first guide tracks 70 until they reach the second positions 74, and at which stage the leaf 2 is in the folded state.

Conversely, as the worktop 60 is being hinged in the direction of the arrow B from the folded state to the usable state, initially the first pivot pins 19 slide in the first guide tracks 70 in the direction of the arrow J from the second positions 74 to the first positions 73 in the corresponding first guide tracks 70, while the slideable elements 25 remain in the second positions 27. When the first pivot pins 19 are in the first positions 73 engaged and retained in the bulbous portions 85 of the respective first guide tracks 70, further upward hinging movement of the leaf 3 in the direction of the arrow B results in the slideable elements 25 sliding along the second guide tracks 14 in the direction of the arrow F from the second positions 27 to the first positions 26. Thus, when the worktop 60 is in the usable state with the second guide tracks 14 in the support state and the struts 15 in the first state, the first pivot pins 19 are located in the corresponding first guide tracks 70 in the first positions 73. When the worktop 60 is in the folded state with the second guide tracks 14 in the rest state and the struts 15 in the second state, the first pivot pins 19 are located in the second positions 74 in the corresponding first guide tracks 70.

Although retaining means for retaining the slideable elements 25 in the first positions in the second guide tracks 14 of the foldable worktop 60 have not been illustrated, retaining means comprising spring loaded plungers similar to the spring loaded plungers 40 of the support mechanisms 8 of FIGS. 1 to 8 are slideably located in the slideable elements 25 of the support mechanisms 62. Similarly, release means for selectively releasing the spring loaded plungers of the retaining means of the support mechanisms 62 of the worktop 60 are also provided, which are similar to the release means provided for the support mechanisms 8 of the worktop 1.

Otherwise, the worktop 60 and the support mechanisms 62 and their operation are similar to the worktop 1 and the support mechanisms 8 of FIGS. 1 to 8 and their operation.

Referring now to FIGS. 19 to 26, there is illustrated a worktop according to another embodiment of the invention, indicated generally by the reference numeral 90, which is hingedly coupled to a wall 6 by a pair of spaced apart support mechanisms also according to the invention and indicated generally by the reference numeral 91. The worktop 90 is substantially similar to the worktop 1 and similar components are identified by the same reference numerals. The support mechanisms 91 are substantially similar to the support mechanisms 62 of the worktop 60 which is described with reference to FIGS. 9 to 18, and similar components are identified by the same reference numerals.

The main difference between the support mechanisms 91 and the support mechanisms 62 is that in each support mechanism 91, the second mounting means comprises a second mounting member 92 which carries the second guide track 14. The second guide track 14 is secured to the second mounting member 92 by screws (not shown). The second mounting member 92 is pivotally coupled to a first mounting member 93, which in this embodiment of the invention comprises an elongated first mounting member 93. The mounting plate of the embodiment of the support mechanisms 62 of FIGS. 9 to 18 is omitted in this embodiment of the invention, and the first mounting members 93 of the support mechanisms 91 are unconnected other than through the wall 6. The first and second mounting members 92 and 93 are pivotally coupled together by a main pivot pin 94 which defines a main pivot axis 95, and in turn the hinge axis 7 about which the leaf 3 of the worktop 90 is pivotally coupled to the wall 6. The first and second mounting members 93 and 92, respectively, extend perpendicularly from the hinge axis 7 defined by the main pivot pin 94.

The first mounting member 93 of each support mechanism 91 carries a first guide track 96 which is substantially similar to the first guide track 70 of the support mechanisms 62, and similar components are identified by the same reference numerals. However, in the first guide track 96 the outer side edges of the guide members 76 are closed by side plates 97. This allows the upper connecting members 77 and the upper spacer legs 80 to be dispensed with. A projection 98 extending from the first mounting member 93 adjacent the top of the guide members 76 retains the first pivot pin 19 in the first guide track 96 of each of the support mechanisms 91.

In this embodiment of the invention the second guide tracks 14 can be removed from the second mounting members 92 and reoriented therein in order to facilitate releasing of the spring loaded plungers 40 from the corresponding receiving openings 43 by the engagement members 45 from either side of the leaf 3. Access openings 100 are provided in respective side walls 100 of each second mounting member 92 in order to accommodate the corresponding engagement member 45 into the receiving opening 43 of the corresponding second guide track 14, irrespective of which of the side walls 101 of the second mounting member 92 adjacent which the receiving opening 43 is located. The advantage of providing the second guide tracks 14 to be removable from and reorientable in the second mounting members 92 of the corresponding support mechanisms 91 is that it allows the second guide tracks 14 to be selectively located in the corresponding second mounting members 92 with the receiving openings 43 and the corresponding spring loaded plungers 40 located on respective selected sides of the second guide tracks 14, and in turn on the second mounting members 92. This in turn allows the engagement members 45 to be located on selected sides of the second mounting members 92, which in turn allows the handle 99 to be located to a selected side of the leaf 3. Otherwise, the second guide tracks 14 are similar to the second guide track 14 of the support mechanisms 8 of the worktop 1.

A handle 99 is pivotally mounted on the underside 33 of the leaf 3, and is coupled to one of the carrier elements 46 of a corresponding one of the support mechanisms 91 for simultaneously urging the engagement members 45 of the support mechanisms 91 in the direction of the arrow K into engagement with the spring loaded plungers 40, for disengaging the spring loaded plungers 40 from the corresponding receiving openings 43 for releasing the slideable elements 25 from the first positions 26.

The first mounting members 93 are secured to the wall 6 at axially spaced apart locations along the hinge axis 7, and the second mounting members 92 are secured to the underside 33 of the leaf 3 at similarly axially spaced apart locations relative to the hinge axis 7.

Otherwise, the worktop 90 and the support mechanisms 91 are similar to the worktop 1 and the worktop 60 and the support mechanisms 62, respectively, and operation of the worktop 90 and the support mechanisms 91 is similar to that of the worktop 60 and the support mechanisms 62, respectively.

The advantage of providing the first mounting means in the form of first guide tracks 70 and 96 permits the use of longer struts 15 in the support mechanisms 62 and 91 than can be used in the support mechanisms 8 of the worktop 1. This results in the first pivot members 19 engaging the first guide tracks 75 and 96 at a distance below the hinge axis 17 when the worktops 60 and 90 are in the usable state which is greater than the corresponding distance in the case of the worktop 1. This in turn allows the struts 15 of the support mechanisms 62 and 91 when supporting the leaf 3 of the worktops 60 and 90 in the usable state to extend from the first guide tracks 70 and 96 at a more acute angle than the angle at which the struts 15 of the support mechanisms 8 extend from the corresponding first mounting members 9 when supporting the leaf 3 of the worktop 1 in the usable state, and accordingly, the loads which can be supported by the support mechanisms 62 and 91 is greater than the loads which can be supported by the support mechanisms 8.

While the worktops have been described as comprising a leaf supported by two support mechanisms, any number of support mechanisms may be provided for supporting the leaf. Indeed, in certain cases, if the leaf were not too long, it is envisaged that a single support mechanism would be sufficient.

It will be appreciated that any other suitable retaining means for retaining the support mechanisms in the first state besides a detent provided by a spring loaded plunger may be used. It will also be appreciated that other shapes and constructions of first and second guide means may be used, as indeed many other suitable constructions and shape of slideable elements may be provided.

It will also be appreciated that while the leaves have been hingedly coupled to a structure, which has been described as a wall, the leaves could be hingedly coupled to any other structure. It will also be appreciated that the leaf 3 may be hingedly coupled to the structure by a hinge which would directly couple the leaf to the structure or wall. In which case, the piano hinge in the case of the embodiment of FIGS. 9 to 18, and the hinging of the secondary members to the first mounting members 9 of the embodiment described with reference to FIGS. 1 to 8 could be dispensed with, and in which case, the first mounting members would be secured to the wall or structure, and the second mounting members would be secured to the underside of the leaf, with the first and second mounting members being pivotally coupled through the hinge through which the leaf would be hingedly coupled to the wall or structure.

Needless to say, while the worktop has been described as being mounted on a wall, the worktop may be mounted on any other structure, for example, it may be mounted at the end of a kitchen unit in order to extend the worktop of the kitchen unit, or to a table or the like.

While the connecting means for connecting the engagement members 45 has been described as being provided by a link member in the form of a threaded rod, any other suitable connecting means may be provided. An advantage of providing a threaded rod is that it permits adjustment to be made, in order to adjust the engagement members 45 so that they simultaneously engage the corresponding spring loaded plungers.

The invention claimed is:

1. A support for supporting a worktop leaf hingedly coupled to a structure about a hinge axis, the support comprising:

a pair of spaced apart support mechanisms, each support mechanism comprising a first mounting means adapted for coupling to the structure, a second mounting means adapted for coupling to the leaf and being adapted to be pivotal relative to the corresponding first mounting means about the hinge axis between a support state with the leaf in a usable state and a rest state with the leaf in a folded state, and an elongated strut extending between a first end engageable with the corresponding first mounting means, and a second end engageable with the corresponding second mounting means, the second end of the strut of each support mechanism being slideable relative to the corresponding second mounting means of that support mechanism from a first position with the strut in a first state supporting the corresponding second mounting means in the support state to a second position with the strut in a second state and the corresponding second mounting means in the rest state as the second mounting means of that support mechanism is pivoted from the support state to the rest state, wherein the second mounting means of each support mechanism comprises:

a corresponding retaining means for releasably retaining the second end of the corresponding strut in the first position, and wherein the second end of each strut is coupled to a corresponding slideable element, the slideable element of each support mechanism being slideable in the corresponding second mounting means between the first and second positions of the second end of the corresponding strut, and each retaining means comprises:

a detent located in the corresponding slideable element, and a receiving means located in the corresponding second mounting means for releasably engaging the detent to retain the second end of the corresponding strut in the first position thereof, and wherein a release means is provided for disengaging the detent from the receiving means of each retaining means, each release means comprising:

an engagement member for engaging the corresponding detent to urge the detent out of engagement with the corresponding receiving means, and a carrier element carrying the corresponding engagement member, the carrier element being slideably mounted on the corresponding second mounting means and being slideable transversely relative to the second mounting means for urging the engagement member into engagement with the corresponding detent, the carrier element extending externally on opposite sides of the corresponding second mounting means for connecting the carrier element to carrier elements of respective second mounting means located on opposite sides of the second mounting means, and a connecting means is provided for connecting the carrier elements of the release means of the respective support mechanisms for facilitating substantially simultaneous release of the detents from the respective receiving means.

2. A support as claimed in claim 1 in which the first end of the strut of each support mechanism is pivotal in the corresponding one of the first mounting means.

3. A support as claimed in claim 1 in which the second mounting means of each support mechanism comprises an elongated second guide track for guiding the second end of the corresponding strut between the first and second positions thereof.

4. A support as claimed in claim 1 in which the second end of the strut of each support mechanism is pivotally coupled to the corresponding slideable element about a second pivot axis, extending substantially parallel to the hinge axis.

5. A support as claimed in claim 1 in which the first and second mounting means of the respective support mechanisms are pivotally coupled about a main pivot axis, the main pivot axis defining the hinge axis about which the leaf is hingeable between the usable and folded states.

6. A support as claimed in claim 1 in which a secondary mounting means is pivotally coupled to the first mounting means of the respective support mechanisms about a main pivot axis, the secondary mounting means being adapted for coupling to the leaf with the main pivot axis defined between the secondary mounting means and the first mounting means defining the hinge axis of the leaf.

7. A support as claimed in claim 1 in which each support mechanism is adapted for hingedly coupling the leaf to the structure.

8. A worktop leaf hingedly coupled to a structure by a support as claimed in claim 1, the first mounting means of each support mechanism being coupled to the structure, and the second mounting means of each support structure being coupled to the leaf, the second mounting means being pivotal from the support state supporting the leaf in the usable state to the rest state with the leaf in an unusable state as the leaf is pivoted about the hinge axis from the usable state to the folded state.

9. A worktop leaf as claimed in claim 8 in which the support comprises at least three support mechanisms, the respective support mechanisms being axially spaced apart from each other along the hinge axis.

10. A support as claimed in claim 1 in which the first end of the strut of each support mechanism is slideable relative to the corresponding first mounting means between respective first and second positions corresponding to the first and second states of the strut.

11. A support as claimed in claim 1 in which the second end of the strut of each support mechanism is pivotal in the corresponding second mounting means.

12. A support as claimed in claim 1 in which the first mounting means of each support mechanism comprises an elongated first guide track.

13. A support as claimed in claim 1 in which the detent of each support mechanism comprises a spring loaded plunger spring biased by a corresponding compression spring, the compression spring acting between the corresponding slideable element and the plunger.

14. A support as claimed in claim 1 in which the receiving means of each support mechanism comprises a receiving opening formed in the corresponding second mounting means for receiving the detent.

15. A support as claimed in claim 1 in which the engagement member of each support mechanism is spring biased out of engagement with the corresponding detent.

16. A support as claimed in claim 1 in which the support mechanisms are configured so that when the second mounting means are in the support state with the leaf in the usable state, the leaf extends outwardly from the structure, and when the second mounting means are in the rest state with the leaf in the folded state, the leaf depends downwardly from the hinge axis.

17. A support as claimed in claim 1 in which each support mechanism is configured to lie between the leaf and the structure in the rest state of the second mounting means.

18. A support as claimed in claim 1 in which the second mounting means of the support mechanisms are adapted for mounting on an underside of the leaf.

19. A support mechanism for supporting a worktop leaf hingedly coupled to a structure about a hinge axis, the support mechanism comprising:

a first mounting means adapted for coupling to the structure, a second mounting means adapted for coupling to the leaf and being adapted to be pivotal relative to the first mounting means about the hinge axis between a support state with the leaf in a usable state and a rest state with the leaf in a folded state, and an elongated strut extending between a first end engageable with the first mounting means, and a second end engageable with the second mounting means, the first and second ends of the strut being slideable relative to the corresponding ones of the first and second mounting means from respective first positions with the strut in a first state supporting the second mounting means in the support state to respective second positions with the strut in a second state and the second mounting means in the rest state as the second mounting means is pivoted from the support state to the rest state, wherein the second mounting means comprises a retaining means for releasably retaining the second end of the strut in the first position, and wherein the second end of the strut is coupled to a slideable element, the slideable element being slideable in the second mounting means between the first and second positions of the second end of the strut, and the retaining means comprises:

a detent, the detent comprising a spring loaded plunger located in the slideable element, and a receiving means located in the second mounting means for releasably engaging the spring loaded plunger to retain the second end of the strut in the first position thereof, and wherein a release means is provided for disengaging the spring loaded plunger from the receiving means, the release means comprising:

an engagement member for engaging the detent to urge the detent out of engagement with the receiving means, and a carrier element carrying the engagement member, the carrier element being slideably mounted on the second mounting means and being slideable transversely relative to the second mounting means for urging the engagement member into engagement with the detent, the carrier element extending externally on opposite sides of the second mounting means for connecting the carrier element to carrier elements of respective second mounting means located on opposite sides of the second mounting means.

20. A support for supporting a worktop leaf hingedly coupled to a structure about a hinge axis, the support comprising:

a pair of spaced apart support mechanisms, each support mechanism comprising a first mounting means adapted for coupling to the structure, a second mounting means adapted for coupling to the leaf and being adapted to be pivotal relative to the corresponding first mounting means about the hinge axis between a support state with the leaf in a usable state and a rest state with the leaf in a folded state, and an elongated strut extending between a first end engageable with the corresponding first mounting means, and a second end engageable with the corresponding second mounting means, the second end of the strut of each support mechanism being slideable relative to the corresponding second mounting means of that support mechanism from a first position with the strut in a first state supporting the corresponding second mounting means in the support state to a second position with the strut in a second state and the corresponding second mounting means in the rest state as the second mounting means of that support mechanism is pivoted from the support state to the rest state, wherein the second mounting means of each support mechanism comprises:

a corresponding retaining means for releasably retaining the second end of the corresponding strut in the first position, and wherein the second end of each strut is coupled to a corresponding slideable element, the slideable element of each support mechanism being slideable in the corresponding second mounting means between the first and second positions of the second end of the corresponding strut, and each retaining means comprises:

a detent located in one of the corresponding slideable element and the corresponding second mounting means, and a receiving means located in the other one of the corresponding slideable element and the second mounting means for releasably engaging the detent to retain the second end of the corresponding strut in the first position thereof, and wherein a release means is provided for disengaging the detent from the receiving means of each retaining means, each release means comprising an engagement member for engaging the corresponding detent to urge the detent out of engagement with the corresponding receiving means, the engagement member of each release means being spring biased out of engagement with the corresponding detent, and a connecting means is provided for connecting the respective release means of the respective support mechanisms for facilitating substantially simultaneous release of the detents from the respective receiving means.

* * * * *